US010344762B2

(12) United States Patent
Abbruzzese Permutt

(10) Patent No.: US 10,344,762 B2
(45) Date of Patent: Jul. 9, 2019

(54) SYSTEM AND METHOD FOR CLEANING SUBMERSIBLE MOTOR PUMPS COVERED WITH SUCTION SLEEVES AND DISPOSED HORIZONTALLY OR VERTICALLY

(71) Applicant: Gino Rocco Abbruzzese Permutt, Vina del Mar (CL)

(72) Inventor: Gino Rocco Abbruzzese Permutt, Vina del Mar (CL)

( * ) Notice: Subject to any disclaimer, the term of this patent is extended or adjusted under 35 U.S.C. 154(b) by 878 days.

(21) Appl. No.: 14/397,013

(22) PCT Filed: Dec. 20, 2012

(86) PCT No.: PCT/CL2012/000074
§ 371 (c)(1),
(2) Date: Oct. 24, 2014

(87) PCT Pub. No.: WO2013/159242
PCT Pub. Date: Oct. 31, 2013

(65) Prior Publication Data

US 2015/0330412 A1 Nov. 19, 2015

(30) Foreign Application Priority Data

Apr. 26, 2012 (CL) ..... 1067-2012

(51) Int. Cl.

| | |
|---|---|
| ***F04D 13/10*** | (2006.01) |
| ***F04D 13/08*** | (2006.01) |
| ***F04D 13/14*** | (2006.01) |
| ***F04D 29/70*** | (2006.01) |
| ***E21B 37/00*** | (2006.01) |

(52) U.S. Cl.
CPC ..... *F04D 13/10* (2013.01); *E21B 37/00* (2013.01); *F04D 13/08* (2013.01); *F04D 13/14* (2013.01); *F04D 29/708* (2013.01)

(58) Field of Classification Search
None
See application file for complete search history.

(56) References Cited

U.S. PATENT DOCUMENTS

| | | | |
|---|---|---|---|
| 5,659,214 | A | 8/1997 | Guardiani et al. |
| 5,674,057 | A | 10/1997 | Guardiani et al. |

(Continued)

FOREIGN PATENT DOCUMENTS

| | | | |
|---|---|---|---|
| EP | 0639716 | A1 | 2/1995 |
| WO | WO 2012/008949 | A1 | 1/2012 |

*Primary Examiner* — Nicole Blan
(74) *Attorney, Agent, or Firm* — Lucas & Mercanti, LLP

(57) ABSTRACT

The invention relates to a cleaning system for submersible motor pumps (3) covered with suction sleeves and disposed horizontally or vertically. The system comprises sensors and a series of ducts for injecting water and cleaning compounds, disposed in the suction sleeve (4) of the pump in three zones, namely: an impeller zone A, a motor zone B and a central suction filter (16) zone C. The system can be applied to two submersible pumps in parallel, each pump driving the injection liquids of the other. The used method comprises five steps: a first step comprising the consecutive washing of zones A, B and C; a second step comprising the injection of cleaning compounds; a third soaking step; a fourth step comprising the consecutive heavy-duty washing of zones A, B and C; and a fifth step corresponding to the end of the method.

3 Claims, 37 Drawing Sheets

(56) References Cited

U.S. PATENT DOCUMENTS

| | | | | |
|---|---|---|---|---|
| 6,872,263 | B1 | 3/2005 | Jansen et al. | |
| 2002/0139526 | A1* | 10/2002 | Skillman | E21B 43/121 166/105.1 |
| 2003/0155314 | A1 | 8/2003 | Gordon | |
| 2005/0139531 | A1* | 6/2005 | Gordon | B01D 29/15 210/108 |
| 2008/0066920 | A1* | 3/2008 | Allcorn | E21B 37/00 166/312 |

* cited by examiner

SYSTEM AND METHOD FOR CLEANING SUBMERSIBLE MOTOR PUMPS COVERED WITH SUCTION SLEEVES AND DISPOSED HORIZONTALLY OR VERTICALLY

CROSS REFERENCE TO RELATED APPLICATION

This Application is a 371 of PCT/CL2012/000074 filed on Dec. 20, 2012 which, in turn, claimed the priority of Chilean Patent Application No. 1067-2012 filed on Apr. 26, 2012, both applications are incorporated herein by reference.

FIELD OF THE INVENTION

The present invention was conceived as a solution to solve basically problems of obstruction, premature wearing, reduction on the lifespan, malfunctioning y higher energy consume, due to the presence of sediments and impurities present in the water and adhered to the mobile and fixed parts of submersible motor pumps covered with suction sleeves, which are in direct contact with the water. The invention corresponds to a cleaning system, for submersible motor pumps, covered with suction sleeves or water tubing, disposed in horizontal or vertical form, above or under the ground, inside empty chambers, without water, or inside tanks with water or inside general common tubing, and comprises series of valves and sensors, disposed in three zones defined as A, impellers, B, motor, C, central of suction filter. The valves and sensors are disposed on, in the sides or under the suction sleeves and also in the suction and discharge pipes, connection flange, of the submersible motor pumps.

PRIOR ART

The proposed invention corresponds to a cleaning system for submersible motor pumps covered with suction sleeves and disposed in a horizontal or vertical form, whose application field was intended as a solution to solve basically obstruction, wearing problems and consequent reduction of life span due to improper operation, thereby causing increased energy consume, due to the presence of sediments, either silt particles, sands and clays and organic matter, such as algae, pieces of wood, plastic, paper, cardboard, organic matter remains, insects, vertebrate and invertebrate animals and inorganic impurities, such as magnesium and calcium salts that increase water hardness, either in cold and heat conditions, metals, glass, sheets, adhered to the impellers and other elements of connection and support of submersible pumps, covered with suction sleeves.

This invention allows submersible pumps, covered with suction sleeves, to operate with water from different sources and qualities. Submersible pumps treated with this cleaning system, allow impelling more frequently, water with more quantity of sediments and impurities (besides the sand), than normally established by the manufacturers (30 to 250 grams of sand/$m^3$). With this, it is greatly expanded the field of application of submersible motor pumps, with suction sleeves because through this invention a greater access to impel dirtier water, specially prolonging the life span of submersible pumps, improving their performance, achieving better cost versus benefit ratio, resulting in a reduction in maintenance costs and reducing energy consumption.

Normally in submersible motor pumps, by impelling clean water, without sediments and impurities the life span is higher, the energy cost is lower, the cost of investment is reduced relative to the benefit obtained and the maintenance cost is reduced compared to those submersible motor pumps that impel lower quality water, i.e. dirtier water, with more sediments and impurities. These sediments and impurities adhering to the surface of all elements of the motor pump, which are in direct contact with water, such as the suction filter (FIG. 8, 9 10, (16)) allowing water to enter the central area C and especially the rotary bodies of submersible motor pumps or impellers (FIG. 10 (14)), and also the connecting elements (FIG. 10 (18)) and support the submersible motor pump (FIG. 9, 10 (17)).

All this causes more wearing and operative difficulty, such as obstruction or adherence, which prevents proper rotation, especially of the impellers of submersible motor pumps. With greater wearing and difficulty to operate these elements, inadequate functioning is produced of the motor pumps and, as a consequence, increased energy demand. Therefore, also occurs a higher cost for maintenance, cost versus benefit ratio deteriorates and mainly reduces the useful life span of submersible motor pumps.

In general, pumping equipment that uses piped submersible motor pumps or suction sleeves or water pipes, is not considered a periodic cleaning of these units, in a way to remove sediments and impurities from poor water quality, often present in them and adhered to the surfaces of the impellers (9, 10 (14)), motor (FIG. 9, 10 (15)), connecting elements (FIG. 10, (18)) and support (FIG. 9, 10 (17)), manhole cover (FIG. 8, (7), air valves (FIG. 8, 10 (8)), of the submersible motor pump.

In general, maintenance and cleaning of submersible motor pumps is performed annually or when pumps require it, in a particular case. The cleaning is not performed during the operation of submersible pumps, but must be disassembled, generally retiring it from the place of operation and taking it to remote areas. Thus, for cleaning of submersible motor pumps, two disassembles must be performed, one in the field, taking out the set of motor pumps with their suction sleeves or water pipes, disposed in horizontal or vertical form and moving them, normally, to workshops, where another disassembly is performed. To do this, the suction sleeves or water pipes which cover the submersible motor pumps and then proceed to disassembly connection components, support and rotating bodies or impellers and bowls, of such pumps.

Subsequently, the cleaning is done manually, cleaning each disassembled part or else, with some pressure device, water hose, pressure sandblasting, polishing and cleaning impellers. Generally, the dissembled components of submersibles motor pumps are treated with pressurized water or commercial cleaning products are used. However; no background exist of utilizing during cleaning of submersible pumps, covered suction sleeves, cleaning products and soaking motor pumps for a time, with these chemicals, in the place where these pumps operate.

What exists are pressurized devices, filters or motor pumps of different types, which can inject chemicals, during some process operation, but these products are not used to clean submersible motor pumps, or any kind of motor pumps, but are used to clean water, which impels the motor pump, or else, are used and directed to a productive process, such as injecting cleaning compounds, to free of residues or impurities, the drip lines in agriculture.

Normally submersible motor pumps, are disposed forming part of large industrial pump equipment, either in the mining industry, agriculture, potable water, in urban or rural medium, public and private buildings; hospital, industrial, hotel, sports and tourism developments, arranged horizontally or vertically, above or under the ground and on complex or sophisticated equipment and sometimes non operative, because it cannot be suspend in many cases, production processes and other cases due to the large distances to the control centers.

Therefore, periodically disassembly the submersible motor pumps for performing maintenance and cleaning is expensive and often inoperative. Therefore, is only performed annually maintenance cleaning. However, the cleaning that is performed in the submersible motor pumps, when the annual maintenance is performed, is totally different from the devised in this invention. Overall, submersible motor pumps are removed from equipment or wells in which they are operating. To the submersible motor pumps, a general dismantling, of impellers and general parts, which are in direct contact with water.

An annual maintenance cleaning is insufficient to adequately clean sediment particles and impurities adhered to the surface of the rotary bodies or impellers (14) and motor (15) of the submersible motor pumps (3), as well as the connecting elements (18) and support (17) of submersible motor pumps (3) and the inner surface (FIG. 2, 4 (22)) of the suction sleeve.

With this proposed cleaning system, is allowed to constantly maintain a cleaning maintenance in submersible motor pumps, covered with suction sleeves, disposed in horizontal or vertical form, either under or above the ground, in empty chambers or inside tanks or water pipes.

This invention is produced a remarkable improvement, fundamentally extending the life span of submersible motor pumps, covered with suction sleeve, especially releasing sediment and impurities which are adhered or encrusted to impellers, connection elements and the support, leaving them all in its original operating capacity.

GENERAL DESCRIPTION OF THE FIGURES

In general, the cleaning system for submersible motor pumps, covered with suction sleeves use valves for water inlet, called clean water, pressurized and which can be of any quality and source. Also, valves for injecting cleaning compounds are used. In both cases, the valves are also are located above or around the sides of the submersible motor pump, covered with suction sleeve. It is also used, valves for water outlet called dirty water, with sediment and impurities, cleaning product of submersible motor pumps. These valves are placed, under suction sleeve.

In FIGS. 1,2,3,4,5,6 and 7 it is shown a breakdown of the basic general spatial arrangement in which the valves and sensors are locates, in suction sleeve of the submersible motor pumps.

In central zone C, central, of suction filter, there is a set of valves. The sensors are below or on sides of the suction sleeve.

Figure 6:
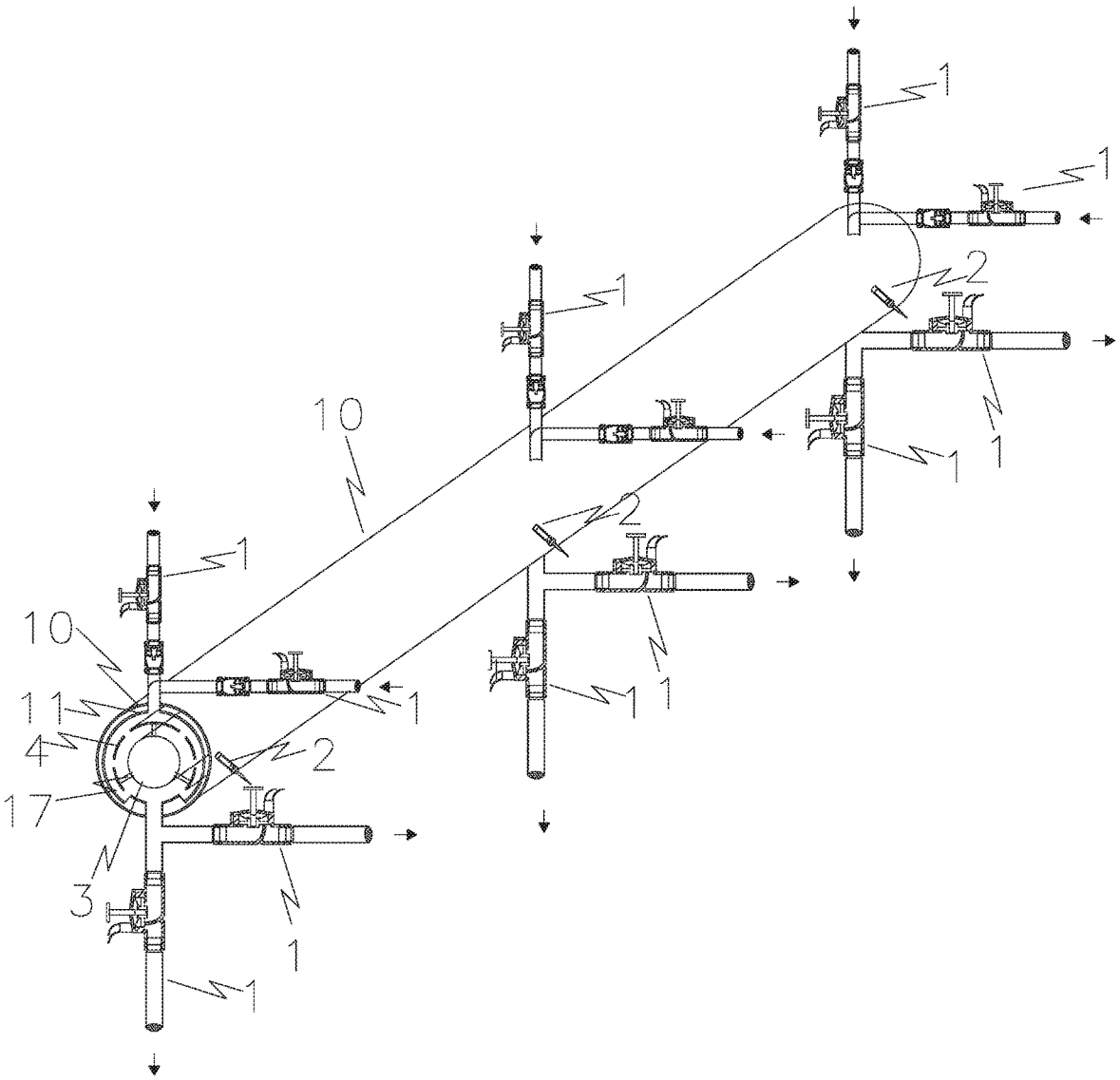

FIG. 6, represents the location of valves with common general cleaning pipe, a set of valves is observed per zone.

Figure 7:
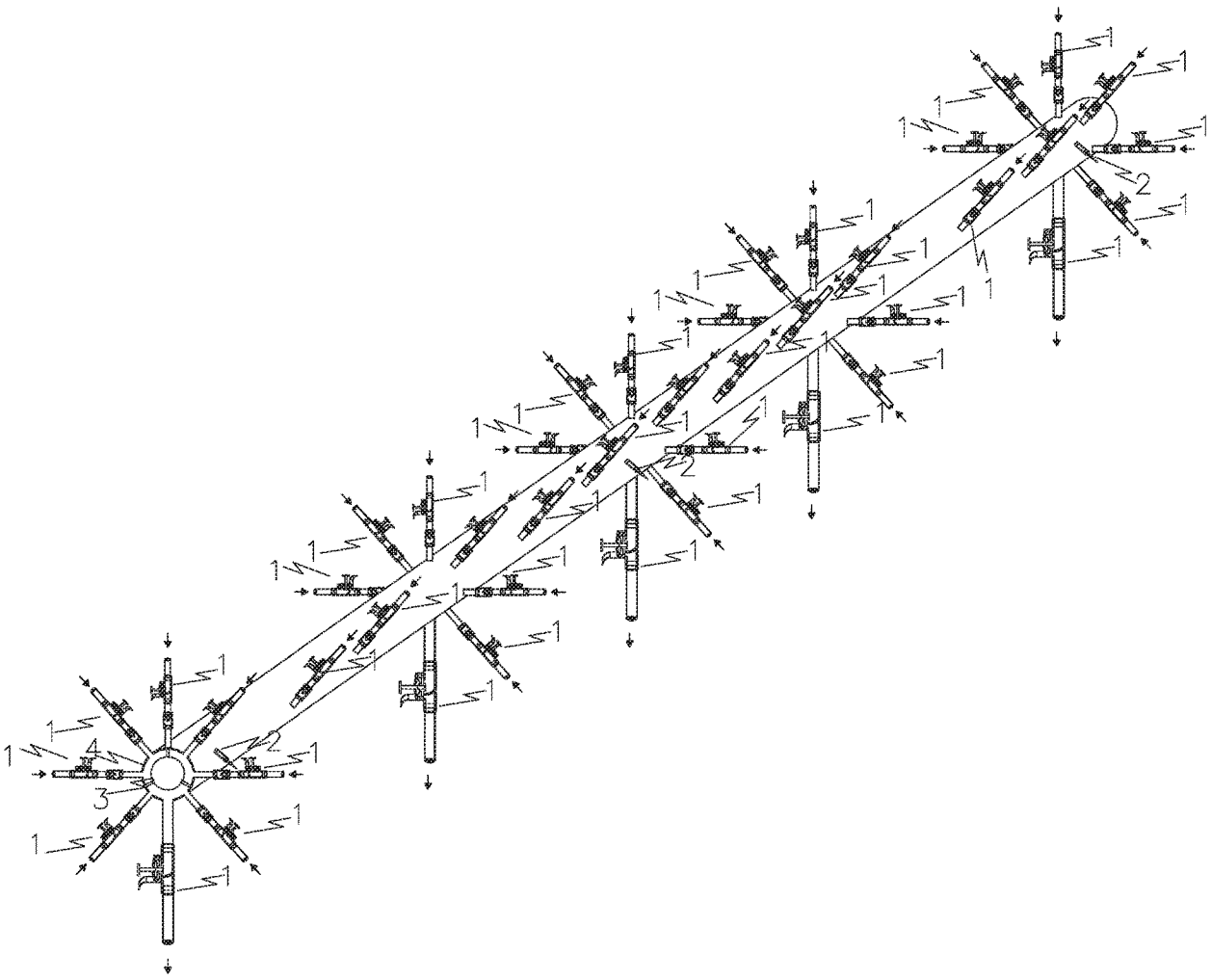

FIG. 7, represents the four ways in which the cleaning valves are arranged in each of the three zones of the submersible motor pump. The arrangement is linear, circular, opposite and helical. Sensors are disposed below or on side of suction sleeve.

Figure 8:
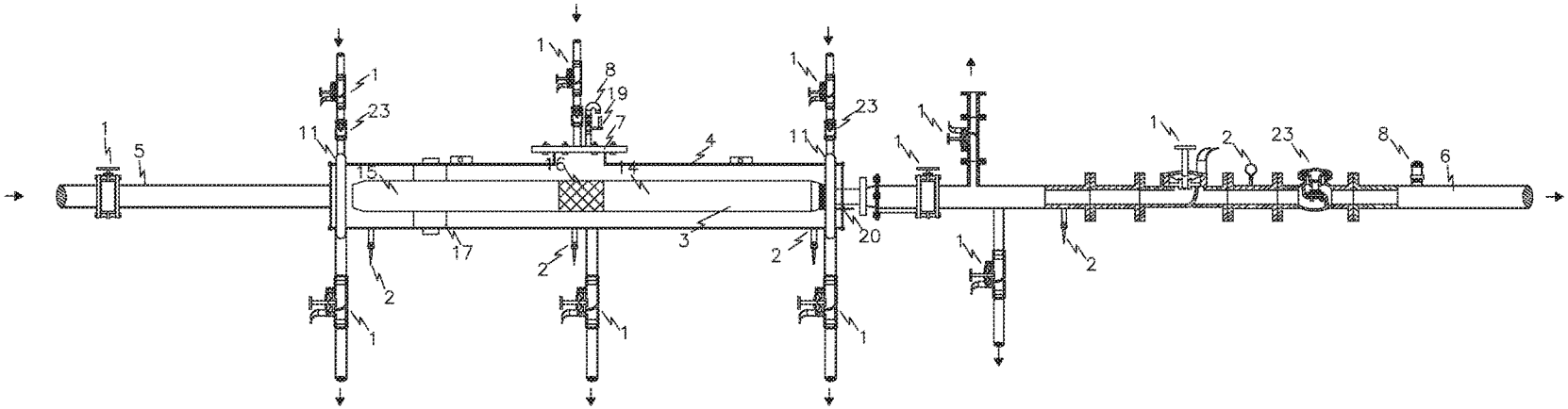
Figure 9:
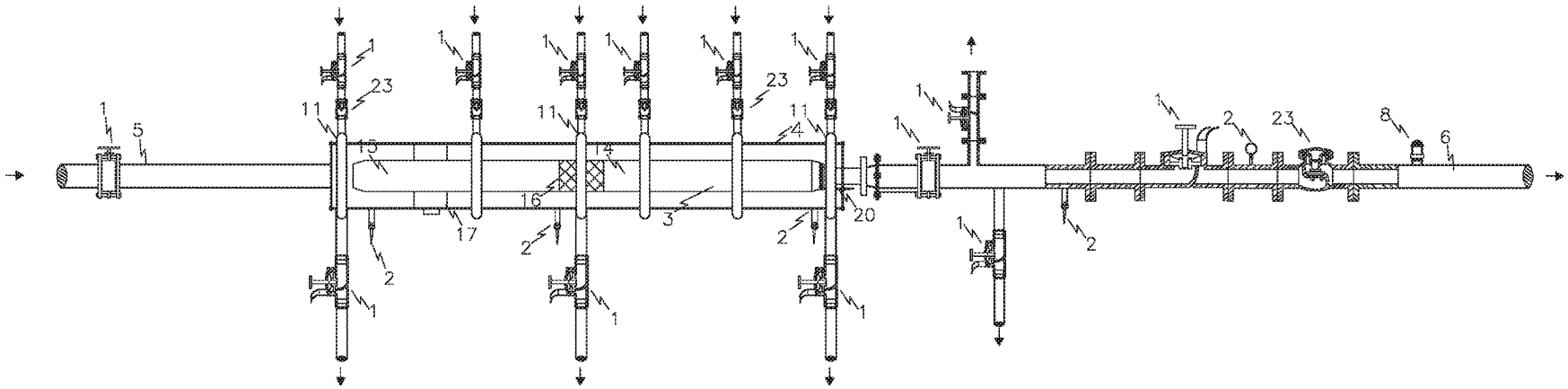
Figure 10:
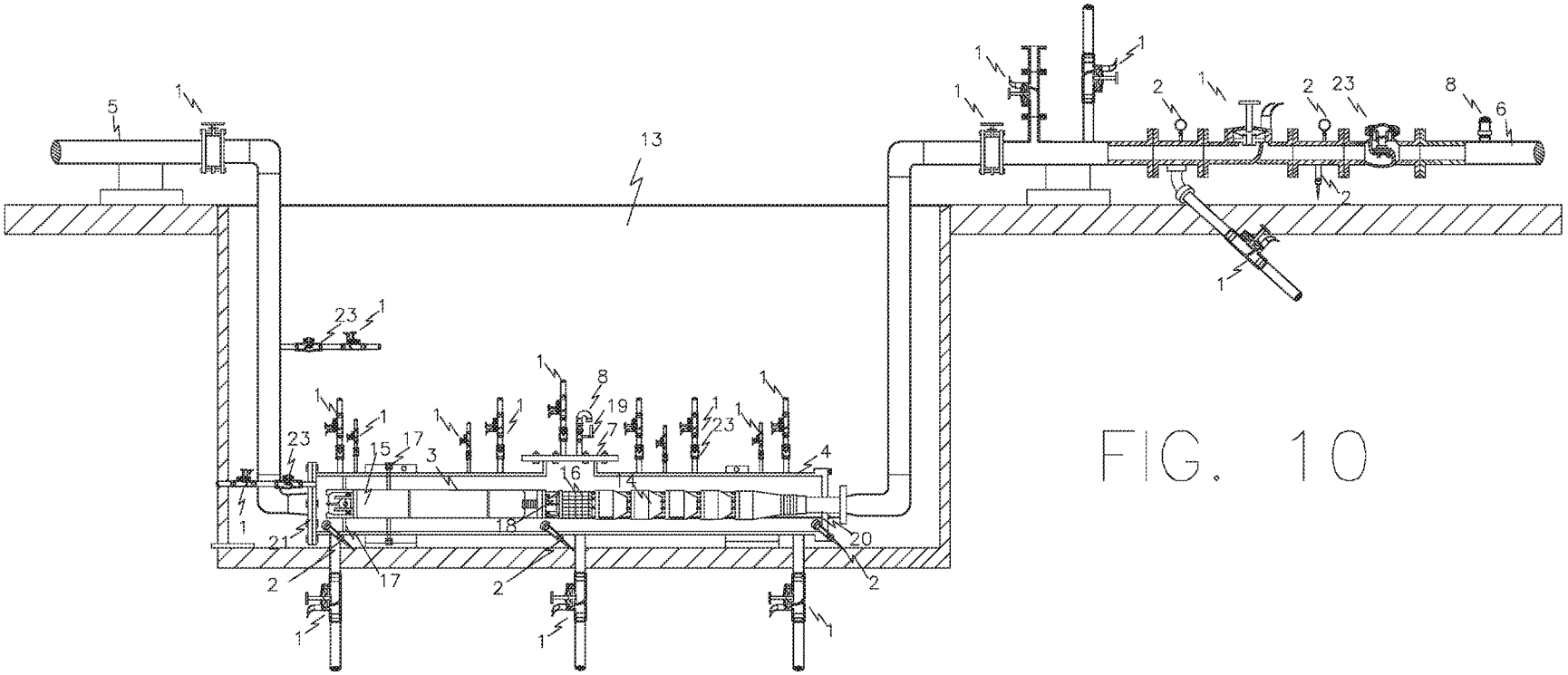
Figure 11:
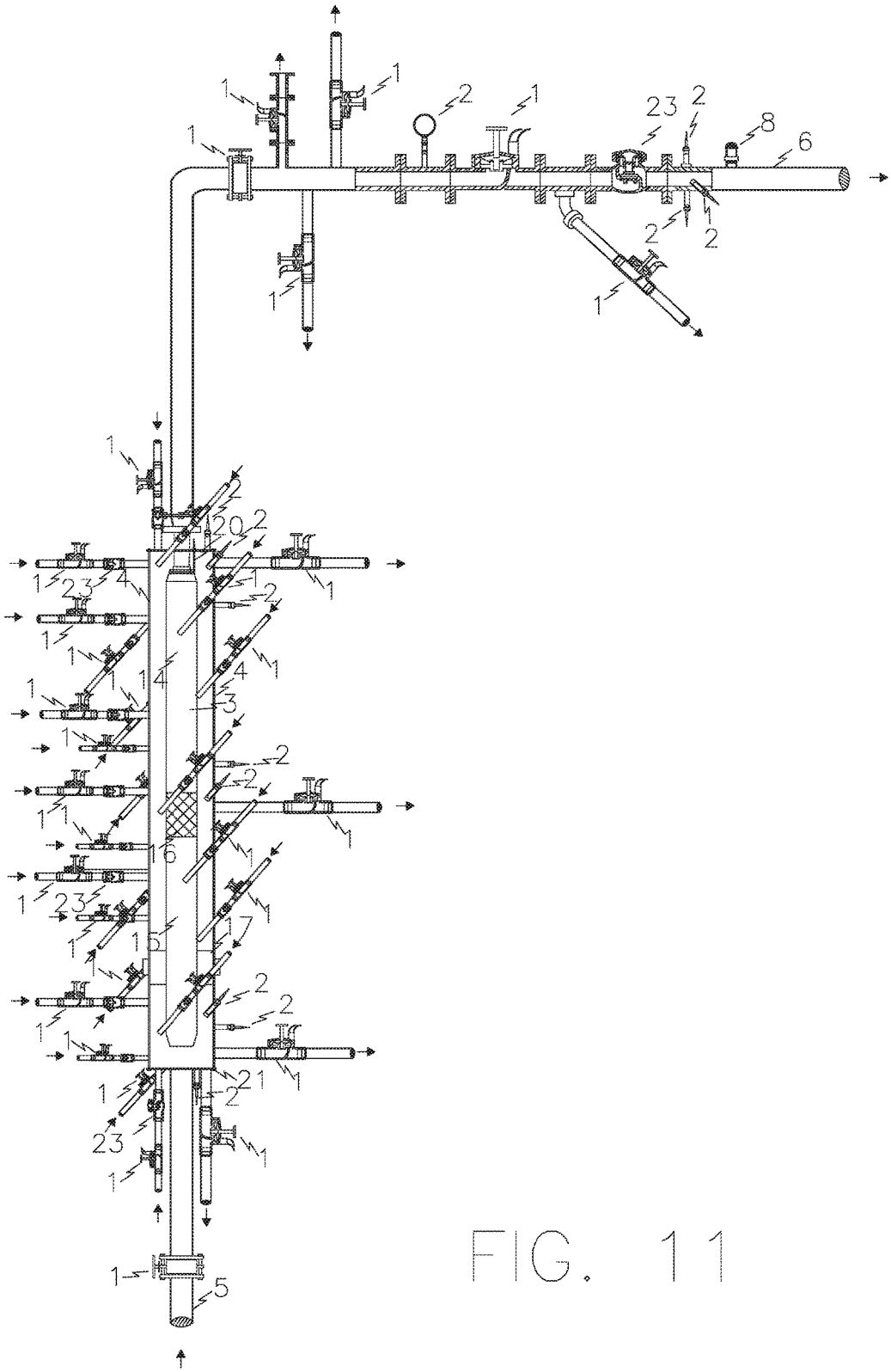

In the FIGS. 8, 9 and 10, the general layout of the valves and sensors for the cleaning system of the submersible motor pumps is observed, depending on how they are placed. In this case, with horizontal arrangement. In FIG. 11 it is shown the vertical arrangement.

FIG. 8, represents general arrangement of individual valves and sensors connected to the suction sleeve of the submersible motor pump, located in horizontal position. It is observed the cleaning system with minimum capacity of sensors and valves, connected directly with common pipe based on cleaning zone, to the suction sleeve of the submersible motor pump, which directs to the manhole cover.

FIG. 9, represents the general arrangement of valves and sensors connected to the suction sleeve of the submersible motor pump, located in horizontal position. It is observed the cleaning system with sensors and valves, directly connected with common piping based on cleaning zone, to the suction sleeve of the submersible motor pump, which does not direct to the manhole cover.

FIG. 10, represents the cleaning system, considering individual valves, directly connected to the suction sleeve of the submersible motor pump with removable manhole cover and placed in horizontal form inside an empty chamber without water.

FIG. 11, represents the cleaning system with a maximum capacity of individual valves directly connected to the suction sleeve and discharge piping of submersible motor pump, placed vertically. The sensors are located on the sides and flanges of the suction sleeve, as in the discharge zone.

In FIGS. 12, 13, 14, 15, 16, 17, 18, 19 and 20 are shown some to the main variations of the cleaning system for submersible motor pumps, with suction sleeves, arranged horizontally and in FIGS. 21, 22, 23, 24, 25 and 26 are shown variations placed vertically.

Horizontal Variations

Figure 12:
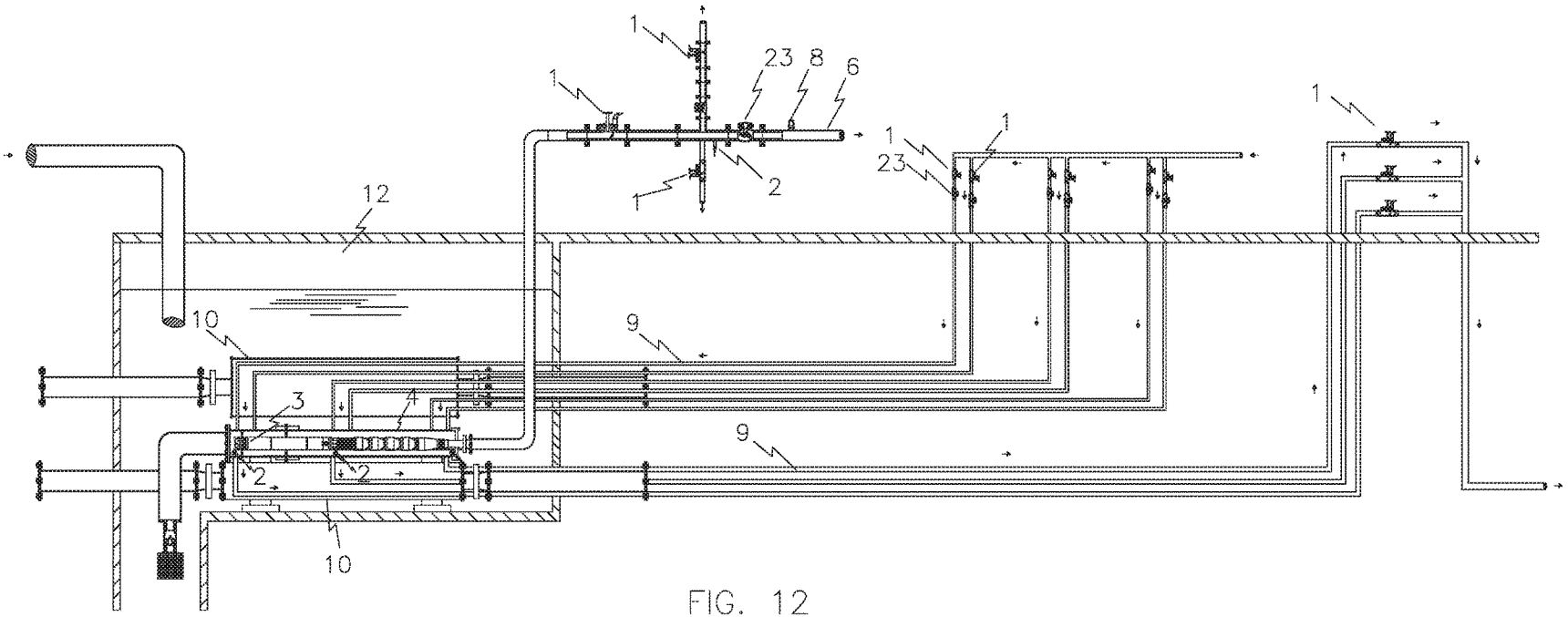

FIG. 12, represents a variant of the cleaning system, consisting of valves connected by individual pipes converging towards a common general cleaning pipe and which is mounted above, below or on the side of the suction sleeve of the submersible motor pump, placed horizontally. The sensors are located on the sides of the suction sleeve.

Figure 13:
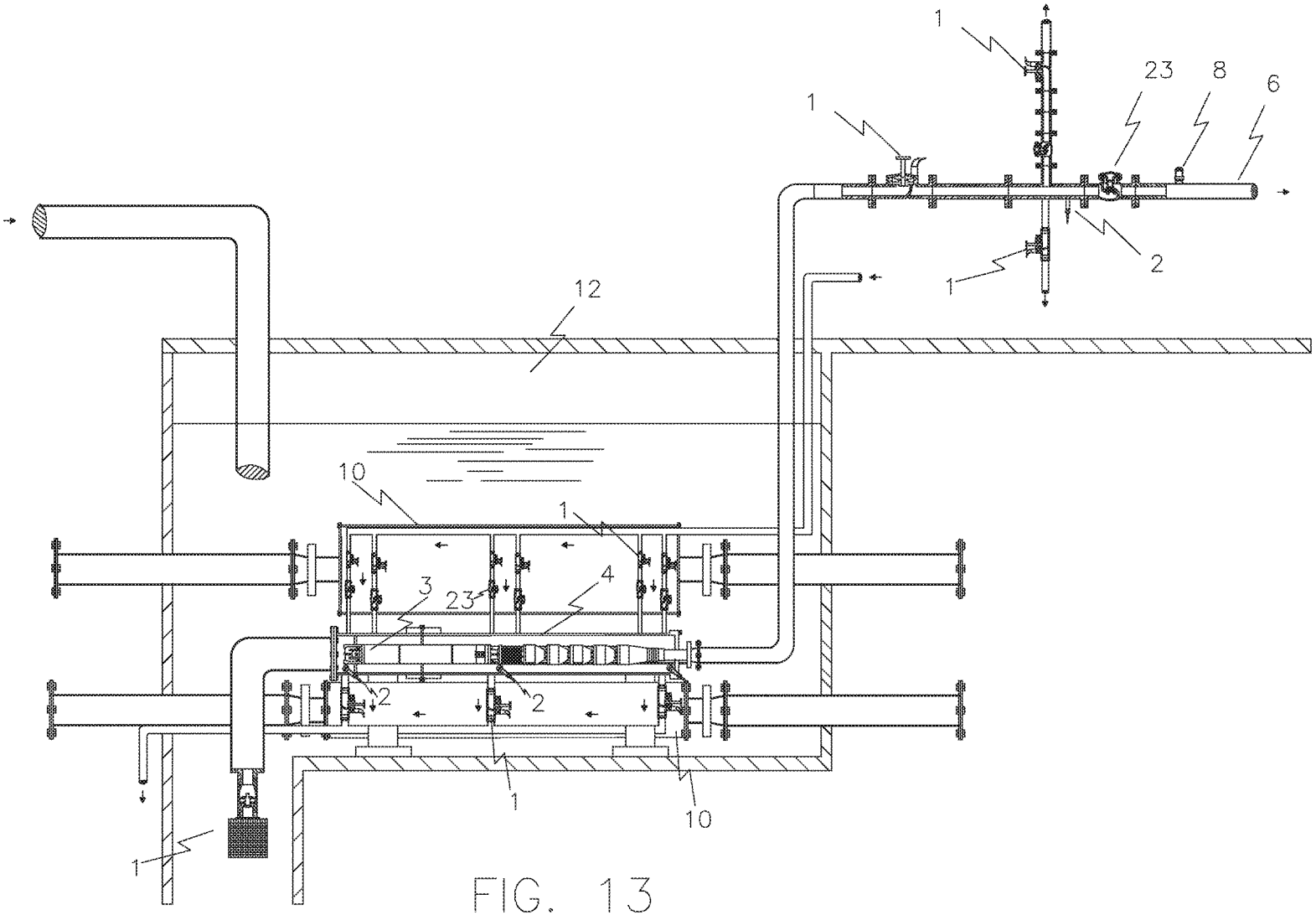

FIG. 13, represents a variant of the cleaning system consisting of valves placed inside the general common cleaning pipes, which are mounted above, below or on the side of the suction sleeve of the submersible motor pump, which is placed horizontally, in the inside of the water tanks. The sensors are located on the sides of the suction sleeve.

Figure 14:
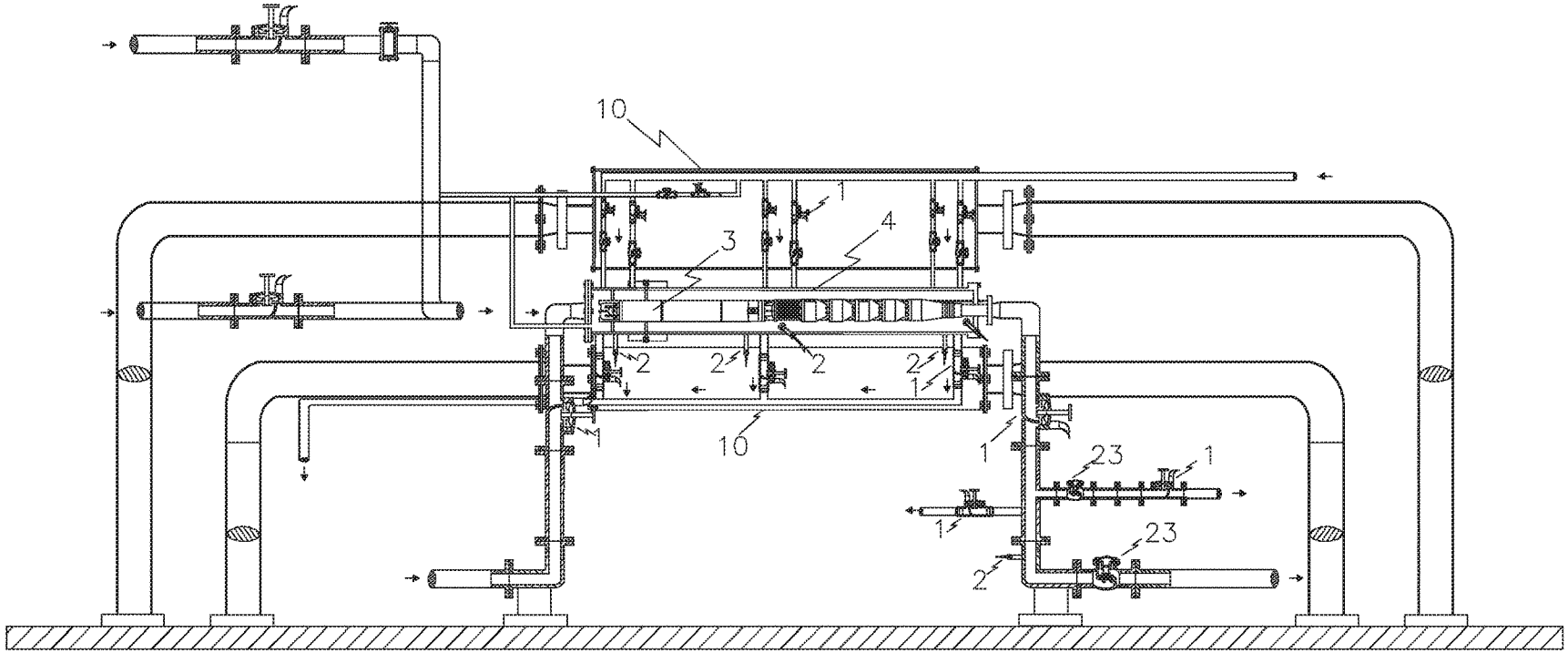

FIG. 14, represents a variant of the cleaning system for submersible motor pumps with suction sleeves, arranged horizontally, with height, and above the ground, with horizontal discharge in series. Valves are placed inside general common cleanings pipes, which are mounted above or under of the suction sleeve of the submersible motor, which is placed horizontally. The sensors are located below or on the sides of the suction sleeve and on the discharge piping.

Figure 15:
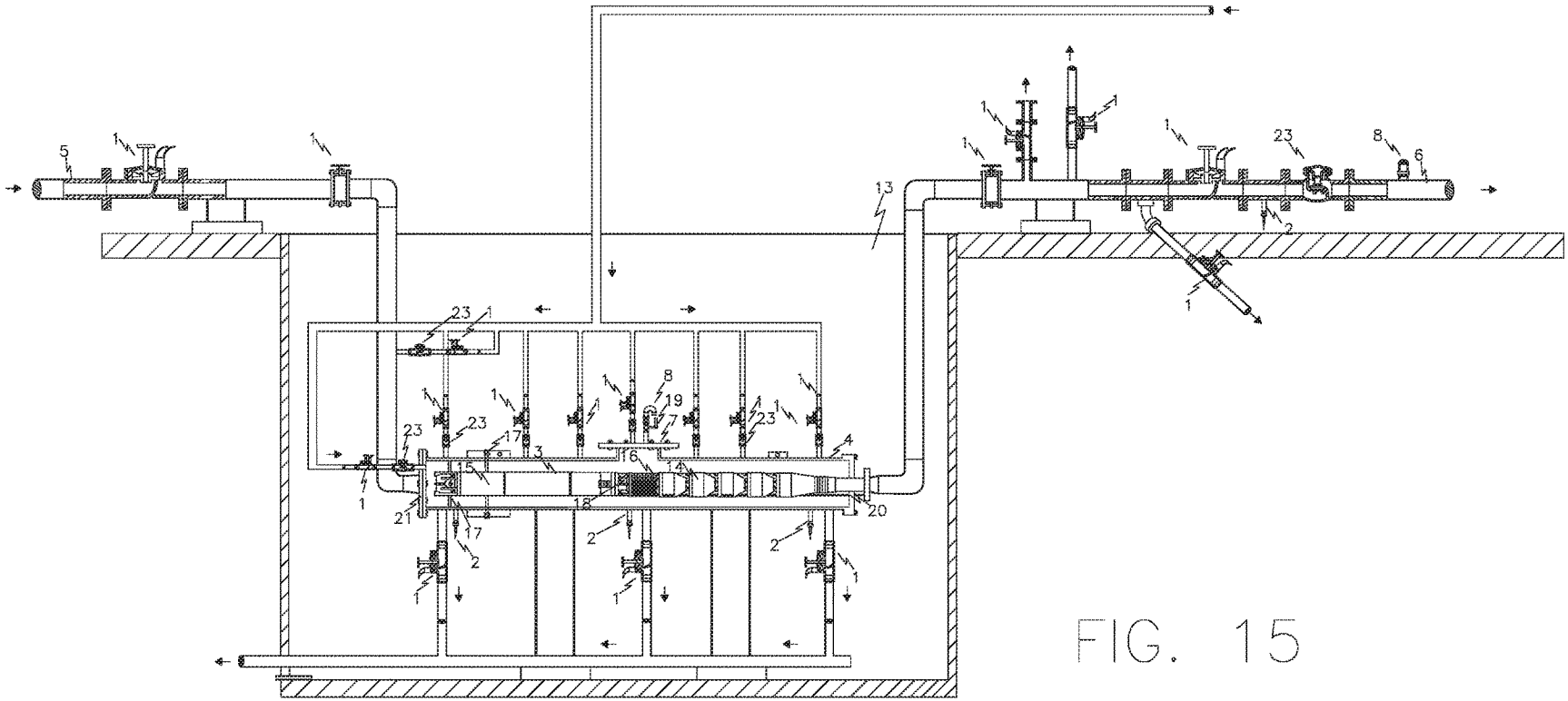

FIG. 15, represents a variant of the cleaning system, in which is being considered submersible motor pumps, placed horizontally, in the inside of empty chambers and having manhole cover. Valves for clean water, dirty water and cleaning compounds are disposed outside the suction sleeve of the submersible motor pump. It is contemplated for dirty water valve, inlet and drain inside empty chambers.

Figure 16:
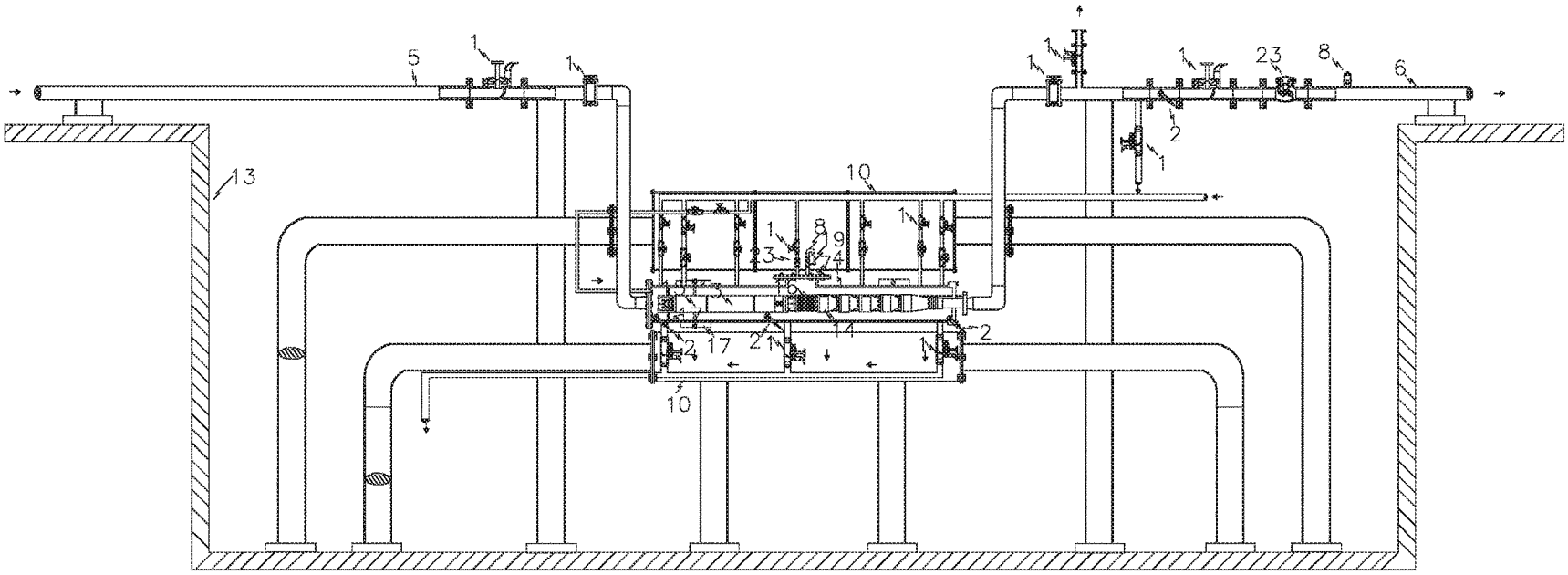

FIG. 16, represents a variant of the cleaning system, considering a submersible motor pumps, positioned horizontally and located inside of empty chambers and having manhole cover and having inner valves, placed on general common cleaning pipes and located above or under the suction sleeve of submersible motor pump.

Figure 17:
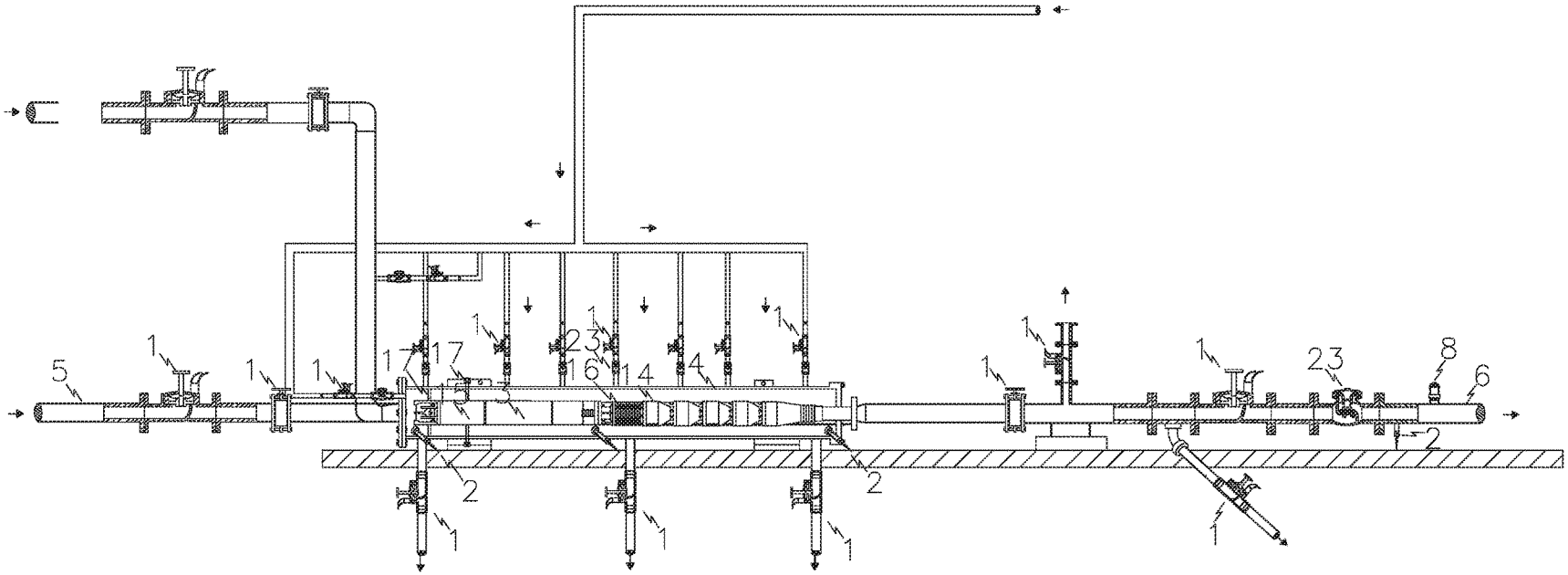

FIG. 17, represents the variation of one or more submersible motor pumps, located above the ground, with horizontal discharge in series. The valves are exterior and with outlet and drain below the ground. Cleaning of the submersible motor pump to be cleaned is performed via external force, pumping with additional motor pumps(s); gravitationally or manually.

Figure 18:
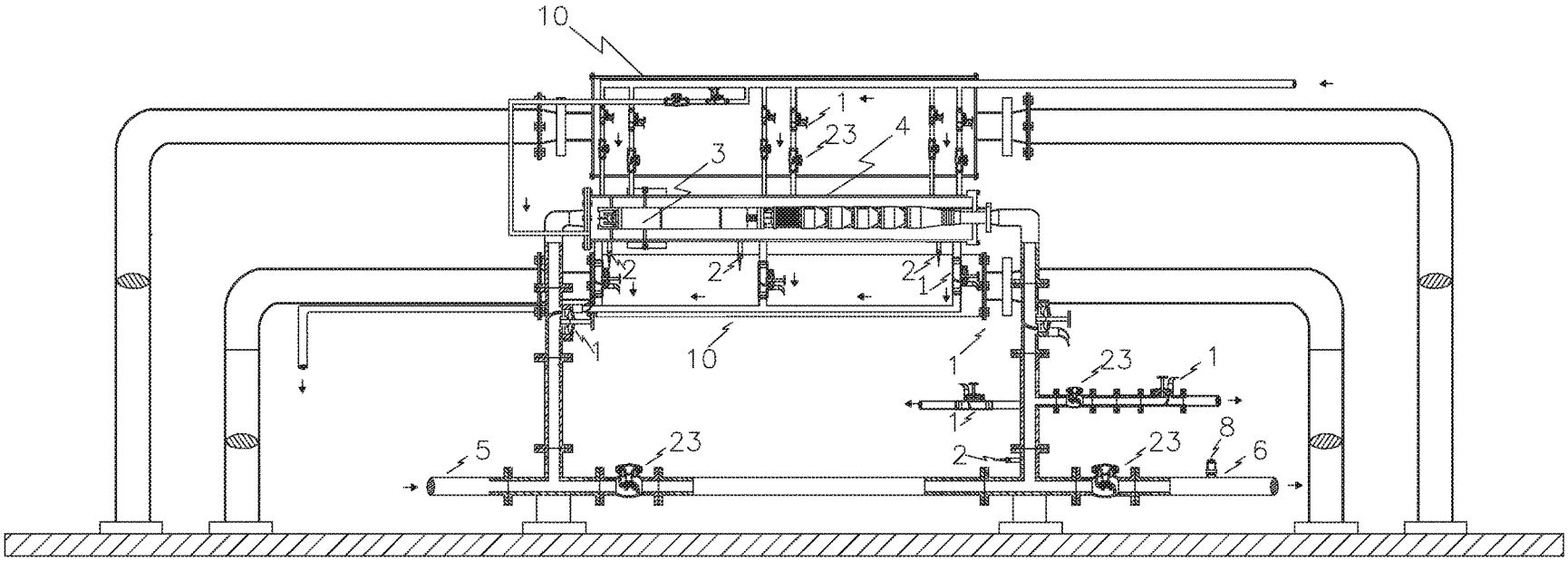

FIG. 18, represents variant of one or more submersible motor pumps, located above the ground, with horizontal discharge and bypass. The cleaning system has inner valves, placed in general common cleaning pipes and located above or under the suction sleeve of the submersible motor pump. Cleaning of the motor pump to be cleaned is performed with external force, pumping with attached pump(s); gravitationally or manually.

Figure 19:
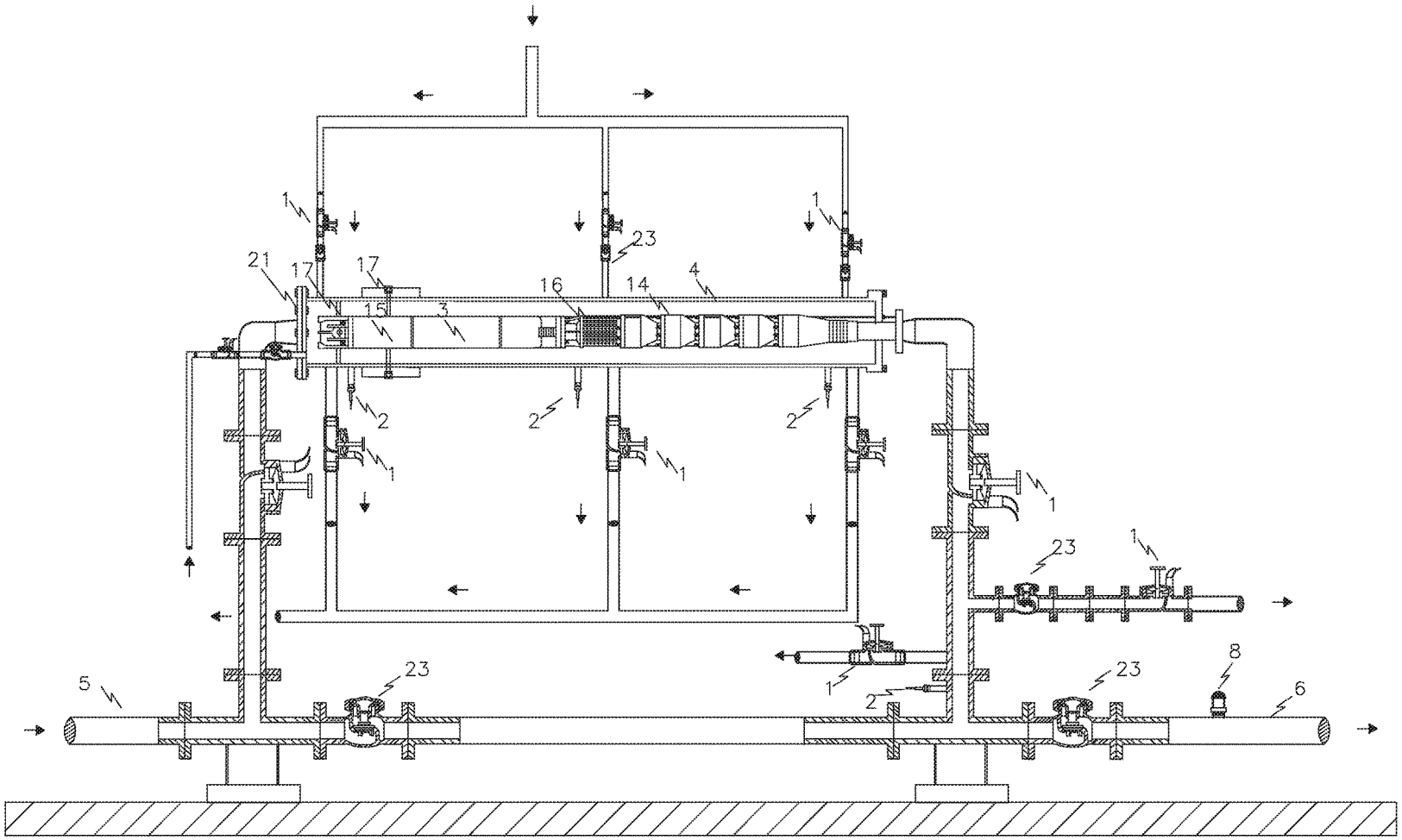

FIG. 19, represents a variant of one or more submersible motor pumps with suction sleeve located above the ground, with horizontal discharge and bypass. This variant considers cleaning system with minimum capacity of individual external valves, connected directly above or under and flanges of the suction sleeve of the submersible motor pump. Cleaning the motor pump to be cleaned is done with external force, pumping with attached pump(s); gravitationally or manually.

Figure 20:
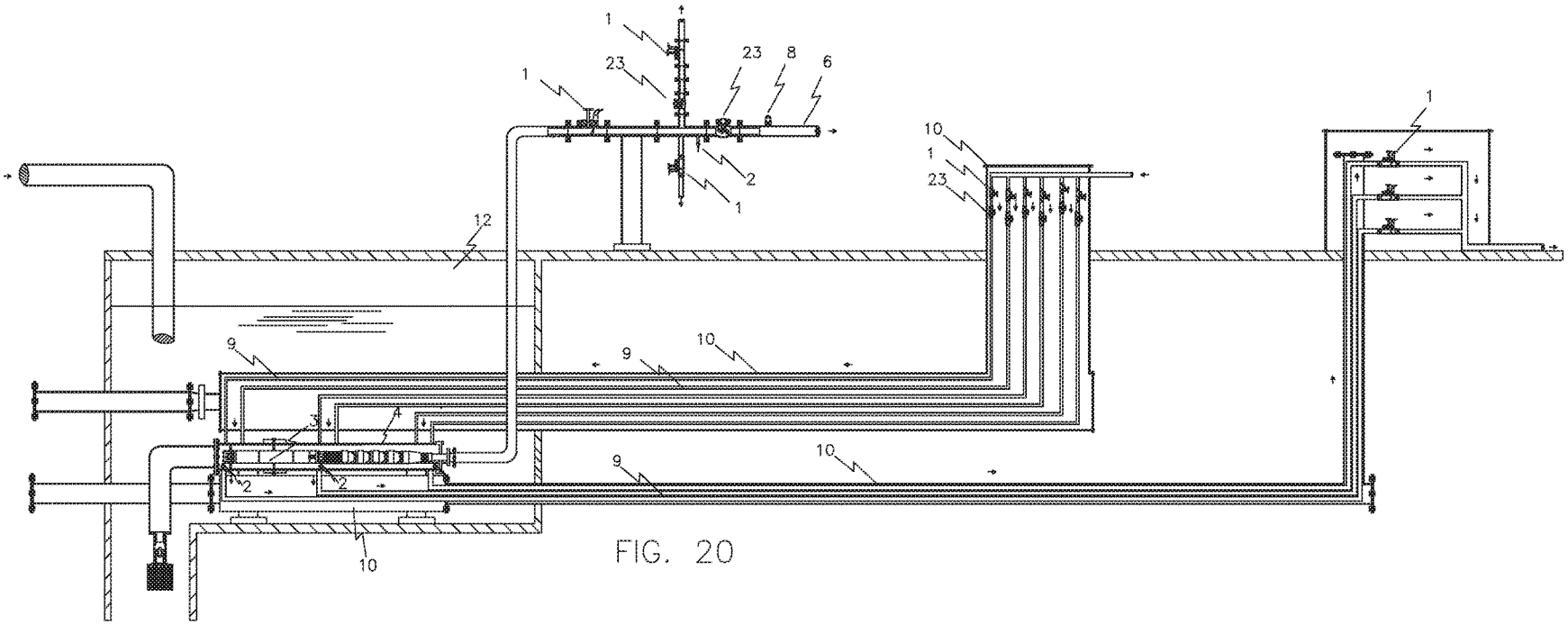

FIG. 20 represents the variation of one or more submersible pumps placed horizontally inside tanks with water and foot valve. Inner valves are considered, placed at the surface and located generally common connection cleaning pipes until arriving to the suction sleeve of the submersible motor pump. The cleaning of the motor pump to be cleaned is performed with external force, pumping with attached pump (s); gravitationally or manually.

Vertical Variations

Figure 21:
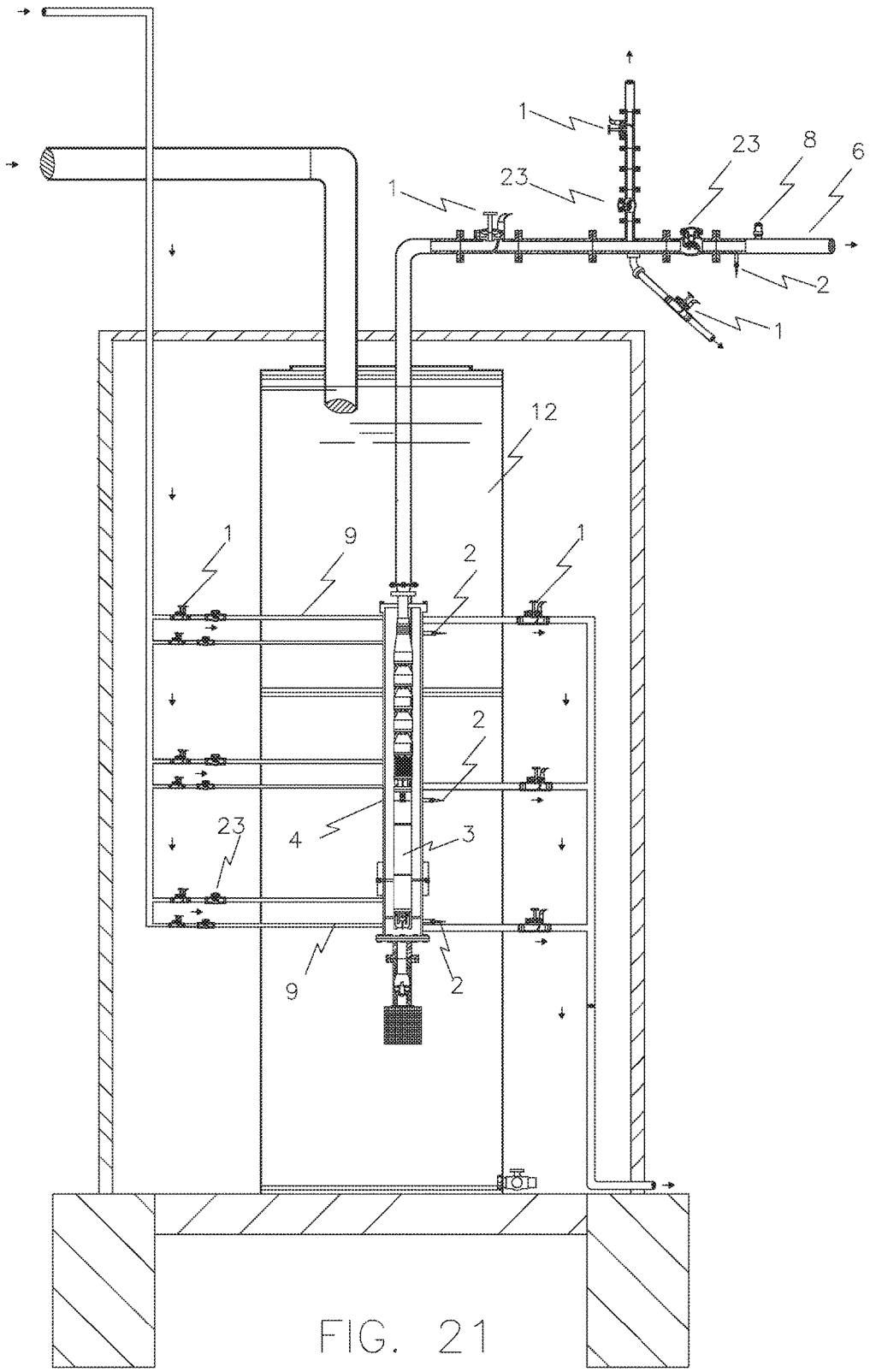

FIG. 21, Represents a variant of the cleaning system, consisting of valves placed outside the pond with water and connected directly by individual pipes, placed by the side of the suction sleeve of the submersible motor pump, which will vertically positioned inside the tank, with water. The sensors (2) are located on the sides of the suction sleeve.

Figure 22:
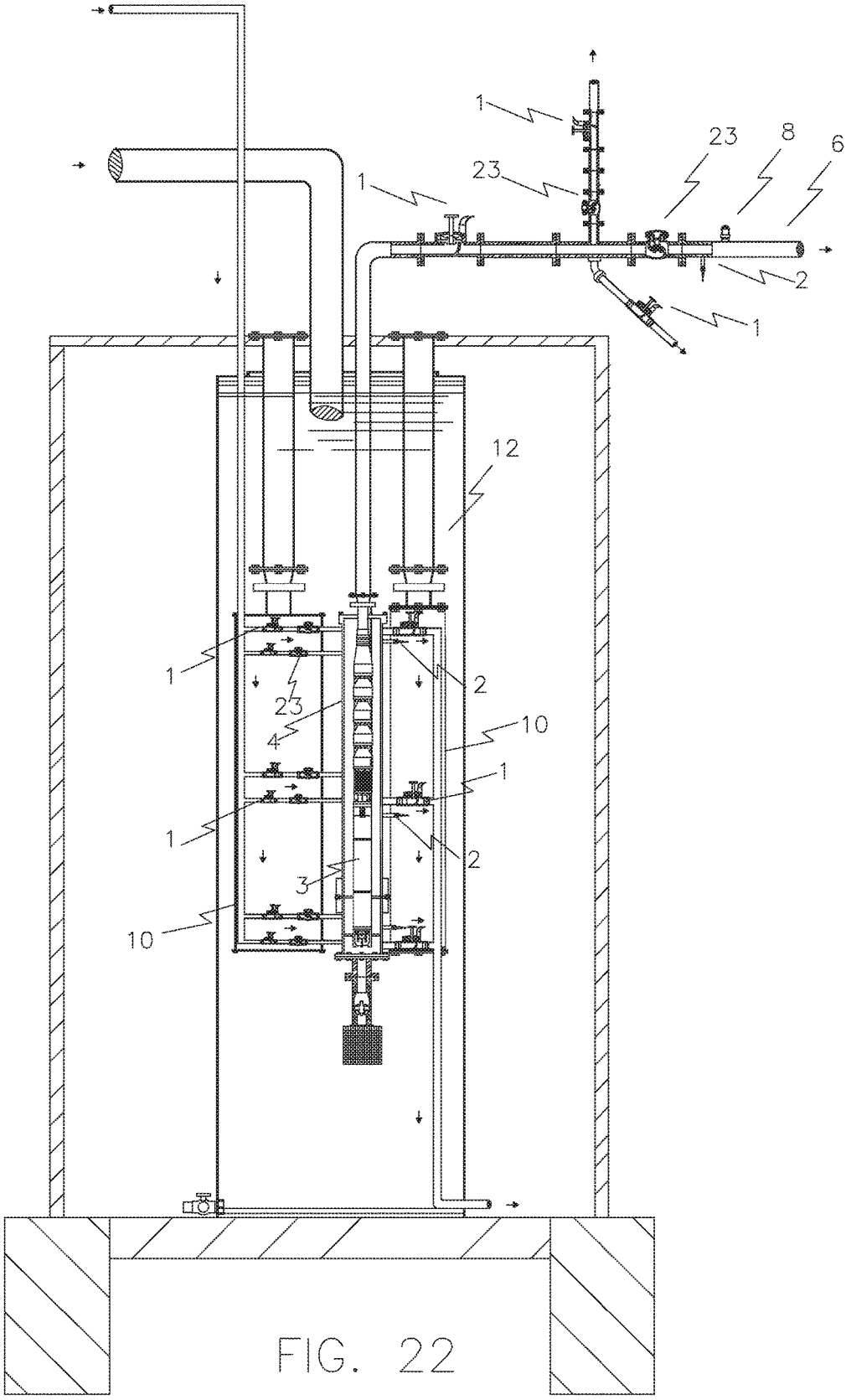

FIG. 22, represents a variant of the cleaning system, considering valve placed inside general common cleaning pipes and located inside the tank of water and, as the sensors, around the sides of the suction sleeve of the submersible motor pump, which goes vertically positioned inside the tank of water.

Figure 23:
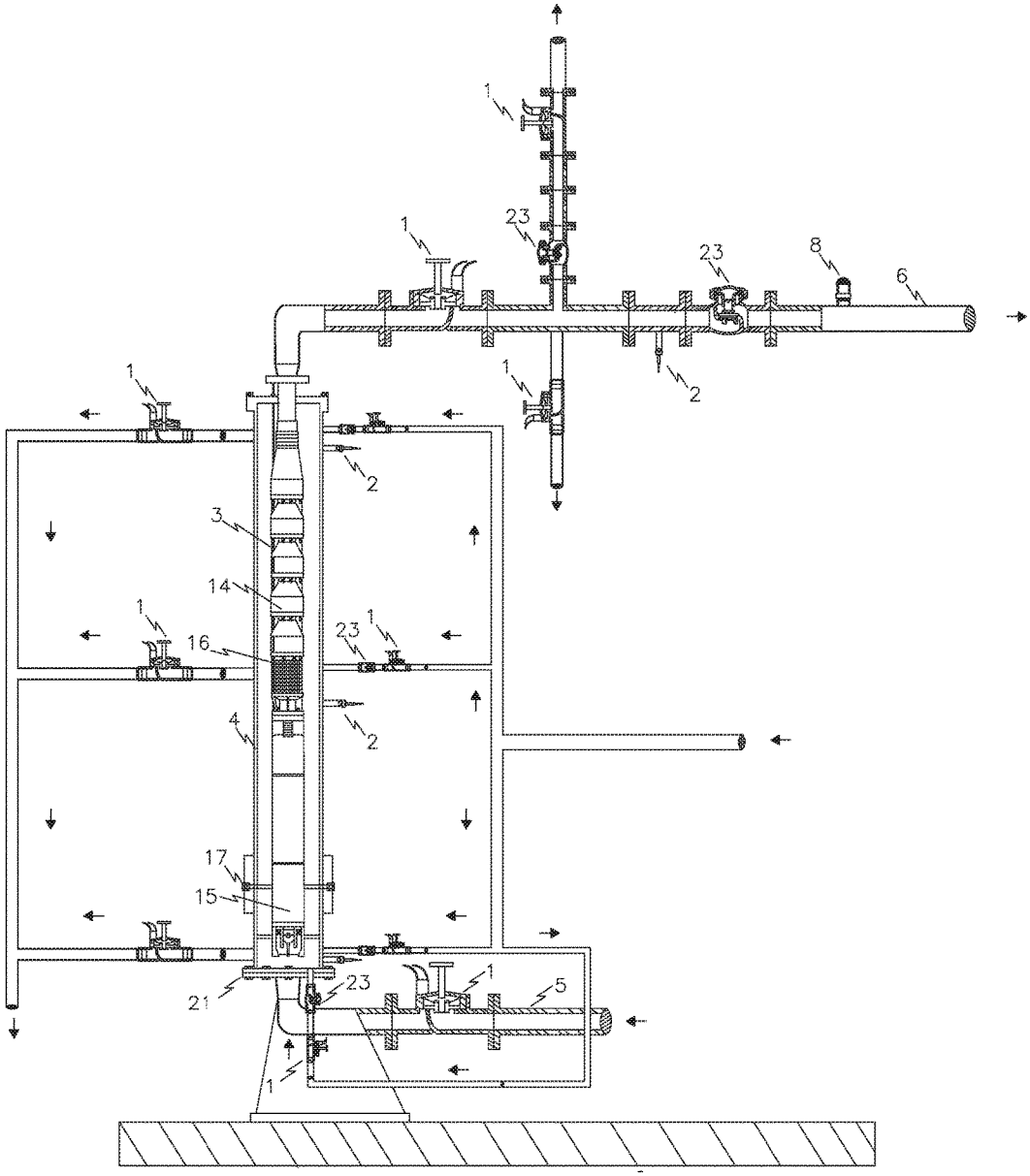

FIG. 23, represents the variation of one or more submersible motor pumps, placed within suction sleeve or pipes with water and placed above the ground, with vertical discharge and in series. This variant of the cleaning system considers external valves, placed by the side of the suction sleeve of the submersible motor pump. Cleaning the motor pump to be cleaned is performed with external force, pumping with attached pumps(s); gravitationally or manually.

Figure 24:
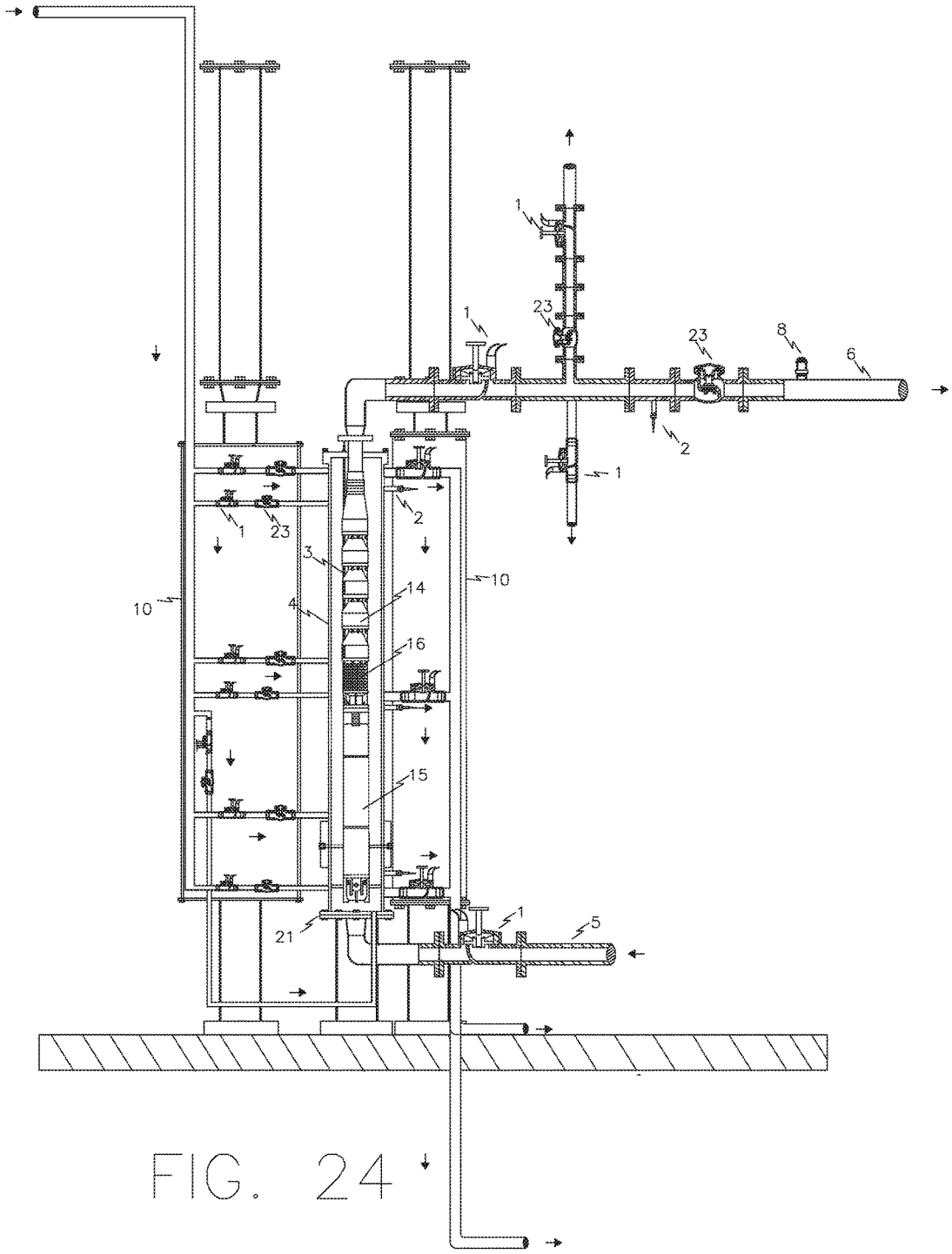

FIG. 24, represents the variant of one or more submersible motor pumps, placed within suction sleeve or pipes with water and placed above the ground, with vertical discharge and in series. Inner valves are considered, placed within general common cleaning pipes and located on the sides of the suction sleeve of the submersible motor pump. The cleaning of the motor pump to be cleaned is performed with external force, pumping with attached pump(s); gravitationally or manually.

Figure 25:
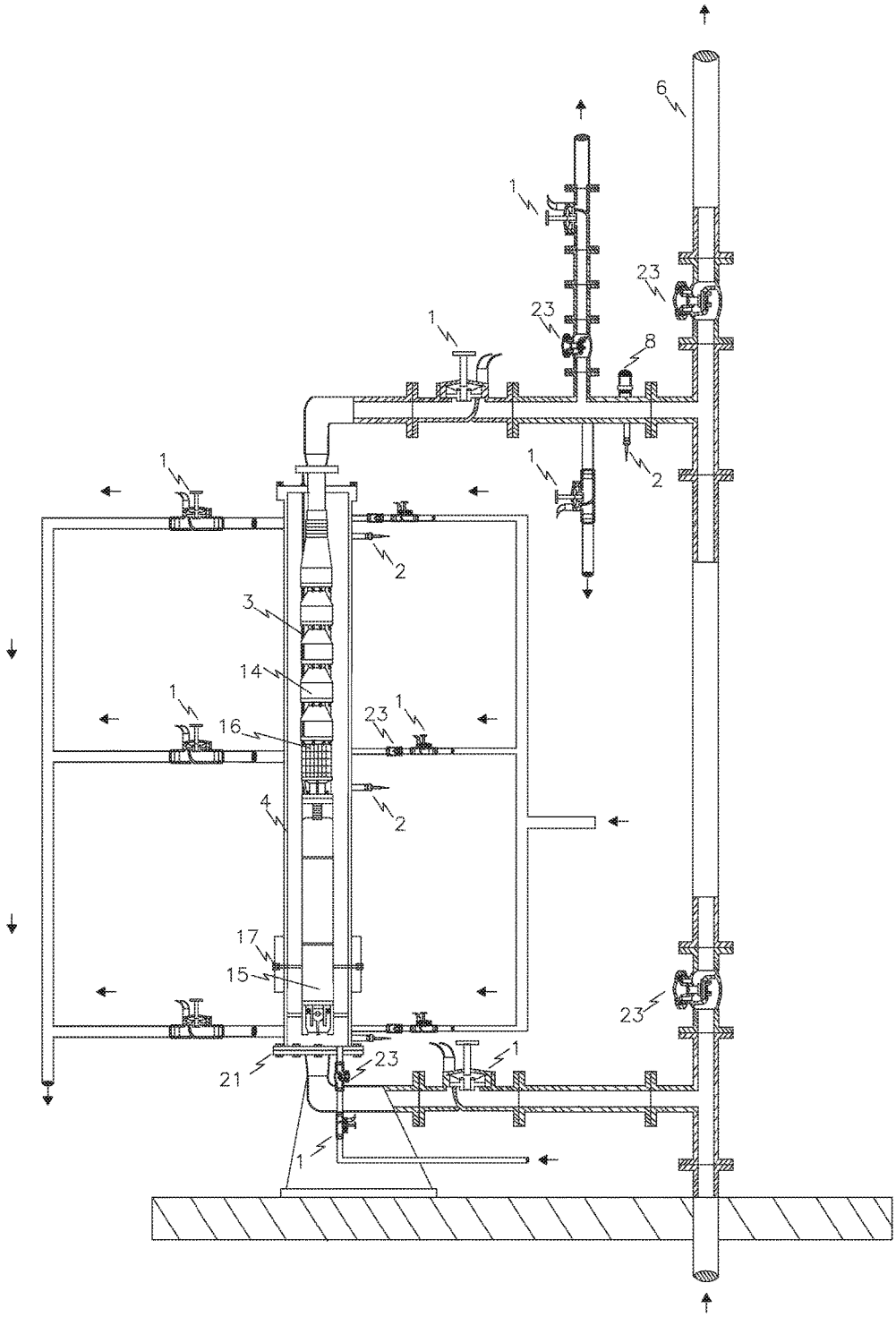

FIG. 25, represents the variation of one or more submersible motor pumps, placed inside suction sleeve and placed above the ground with vertical discharge and bypass. This variant of the cleaning system considers exterior valves, placed by the sides of the suction sleeve of the submersible motor pump. Cleaning the pump to be cleaned is done with external force, pumping with attached pump(s); gravitationally or manually.

Figure 26:
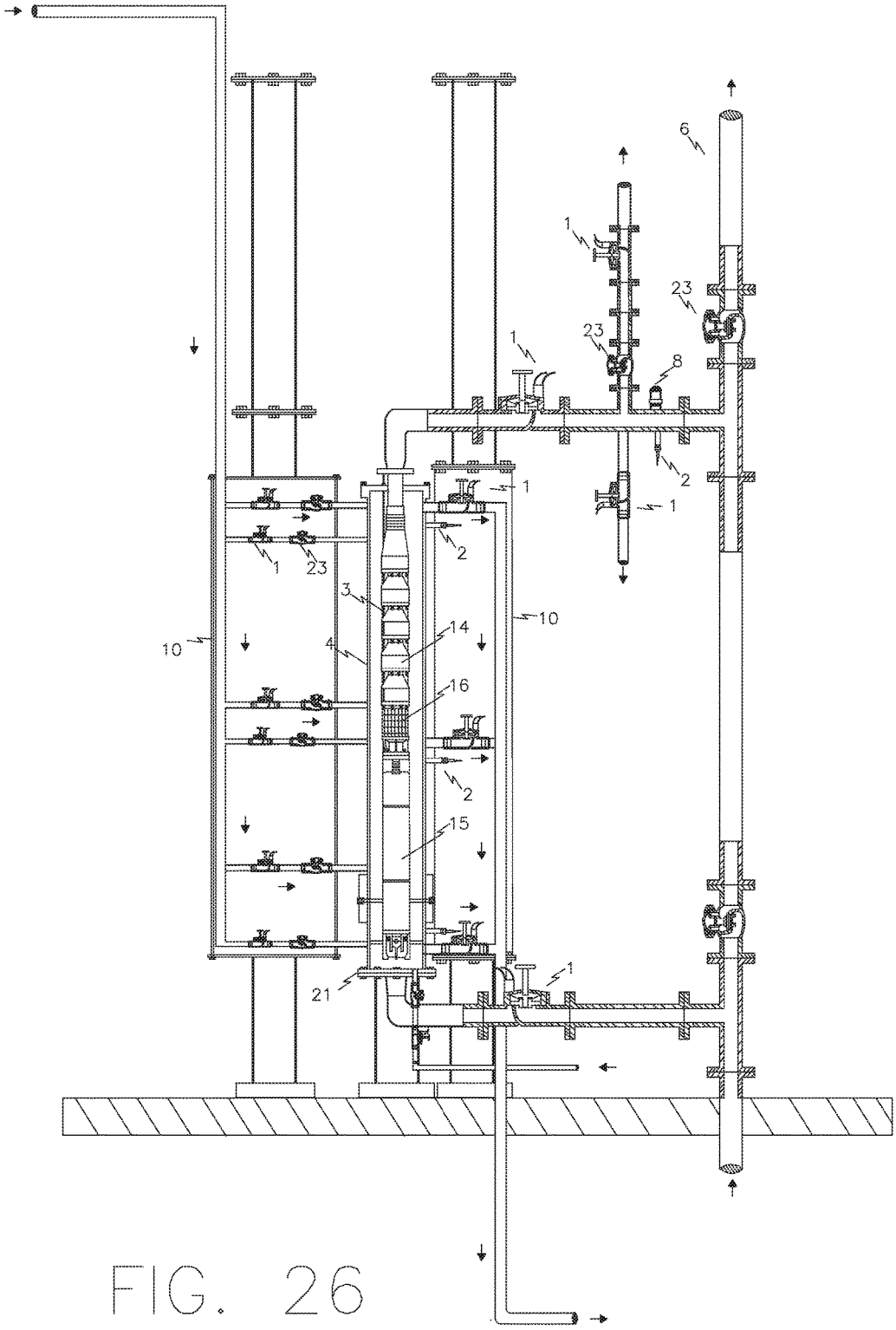

FIG. 26, represents variant of one or more submersibles motor pump placed within suction sleeves and placed above the ground, with vertical discharge and bypass. This variant considers inner valves, placed within common general cleaning and pipes located by the sides of the suction sleeve of the submersible motor pump. Cleaning the pump to be cleaned is performed with external force, pumping with attached pump(s); gravitationally and manually.

Figure 27:
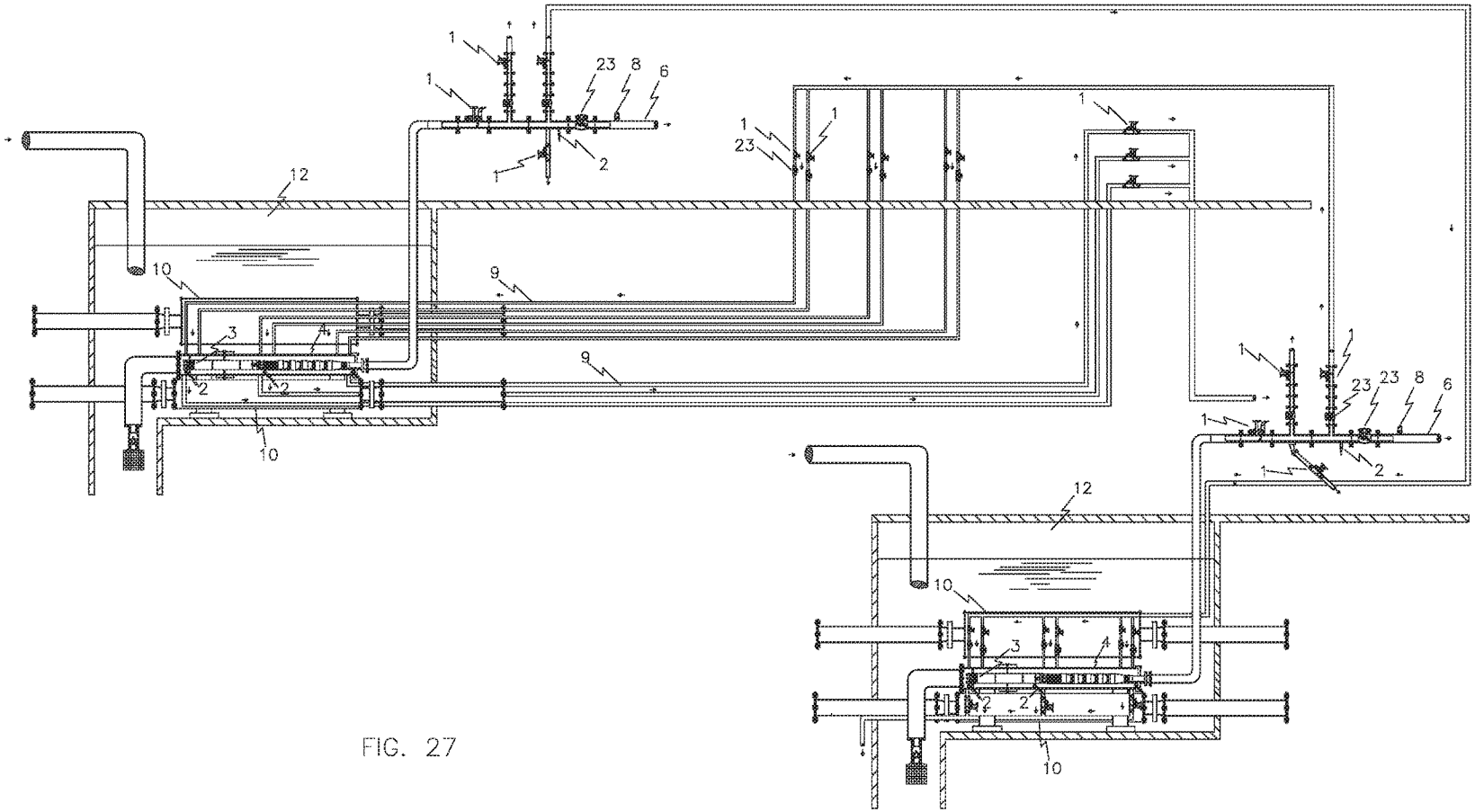
Figure 28:
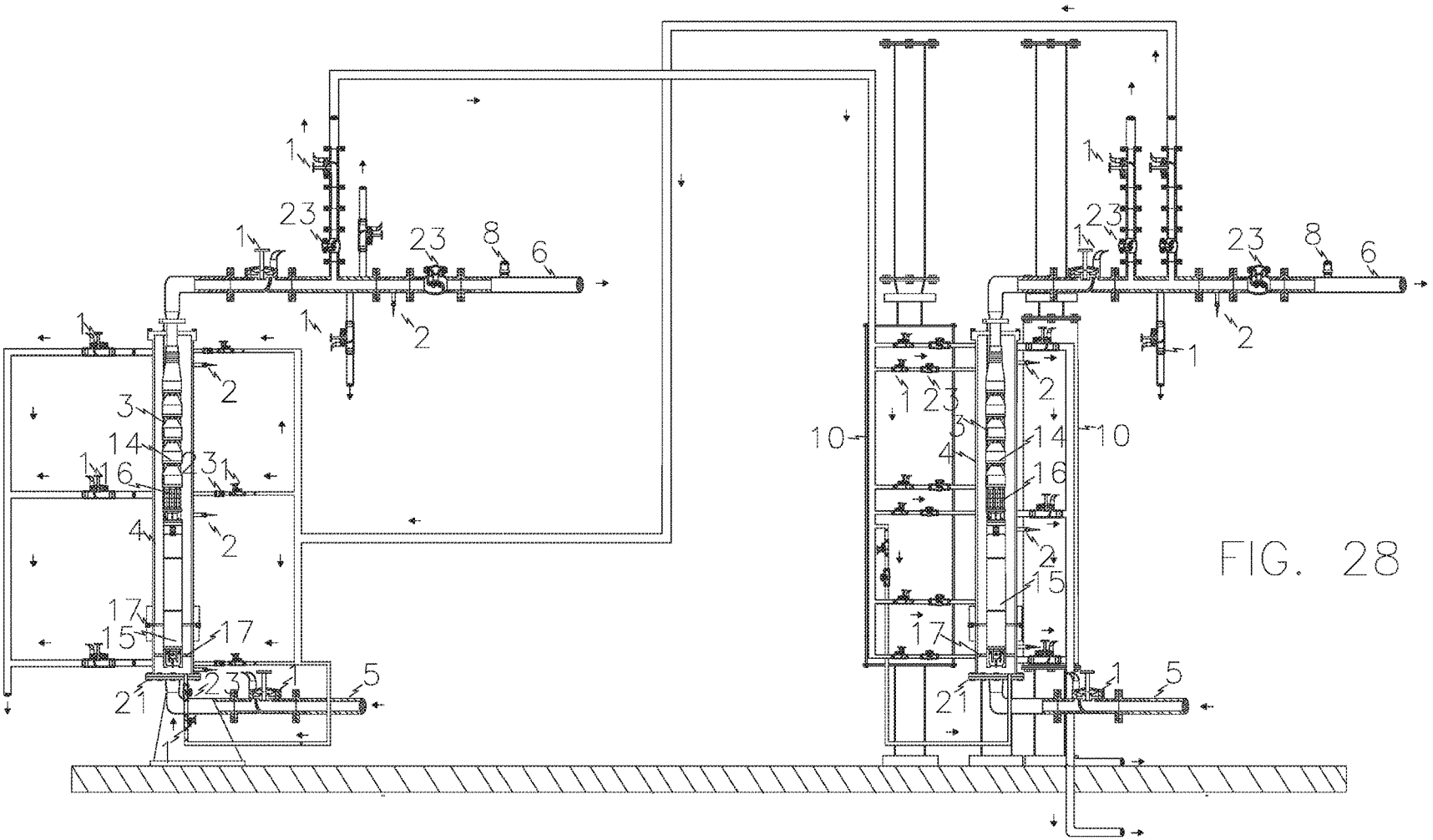

FIGS. 27 and 28 represent two combinations of the cleaning system for submersible motor pumps with suction sleeves and arranged in a vertical and horizontal form, respectively.

Combinations

FIG. 27 represents the combination of cleaning system, between exterior valves, placed on surface and individual pipe connections, until arriving to the suction sleeves of the submersible motor pumps and inner valves, placed in general common cleaning pipes, located above or under suction sleeves of submersible motor pumps, horizontally arranged. The cleaning of the motor pump to be cleaned is done with the additional companion motor pump and vice versa.

FIG. 28, represents the combination of one or more submersible motor pumps, placed inside suction sleeve or water pipes and located above the ground, with vertical discharge and in series. It is observed the combination of the cleaning system, between external valves, placed by the sides of suction sleeves of submersible motor pumps and inner valves, placed inside general common cleaning pipes located by the sides of suction sleeves of submersible motor pumps. Cleaning of submersible motor pump to be cleaned is done with the companion submersible motor pump and vice versa.

In FIG. 29 (*a, b, c, d, e, f, g, h, i*) it is shown the basic functioning scheme of cleaning system for submersible motor pumps with suction sleeves, placed horizontally and vertically.

Functioning of the Cleaning Systems for Submersible Motor Pumps with Suction Slevees, Placed in Horizontal or Vertical Form.

FIG. 29 (*a, b, c, d, e, f, g, h, i*) represents the overall breakdown of the basic scheme of operation of the cleaning system for submersible motor pumps with suction sleeves, placed in horizontal or vertical form. In the water cleaning system cleaning compounds and water and water outlet are applied, in the three zones A, B and C, in 5 stages.

Figure 29A:
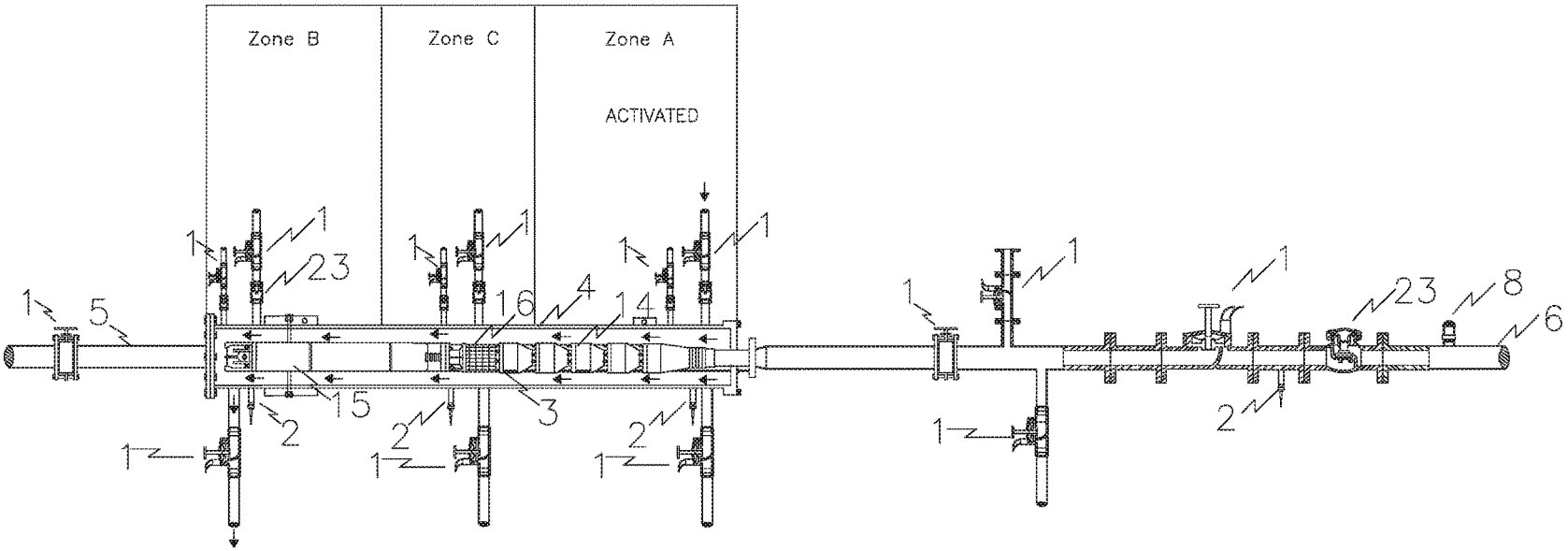

FIG. 29*a*, represents the first general stage of the functioning of the cleaning system and is formed by the first washing, in the zone A of impellers.

Figure 29B:
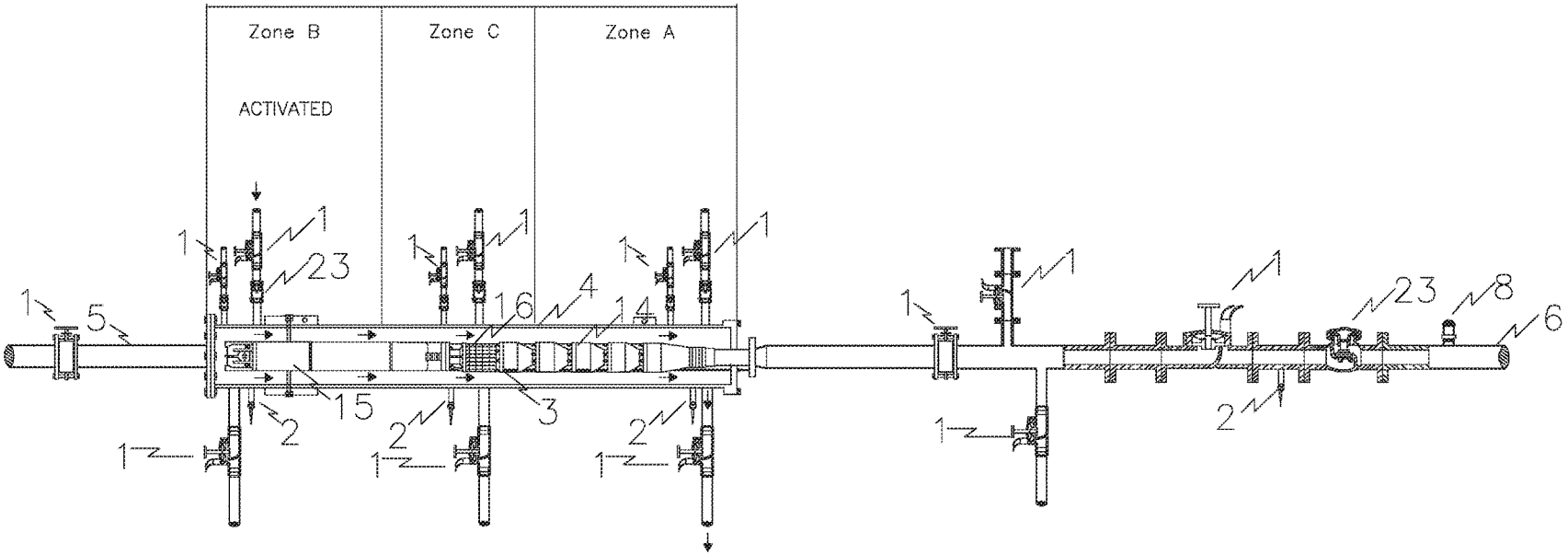

FIG. 29*b*, represents the first general stage of the functioning of the cleaning system and provides the second washing, in the zone B of motor.

Figure 29C:
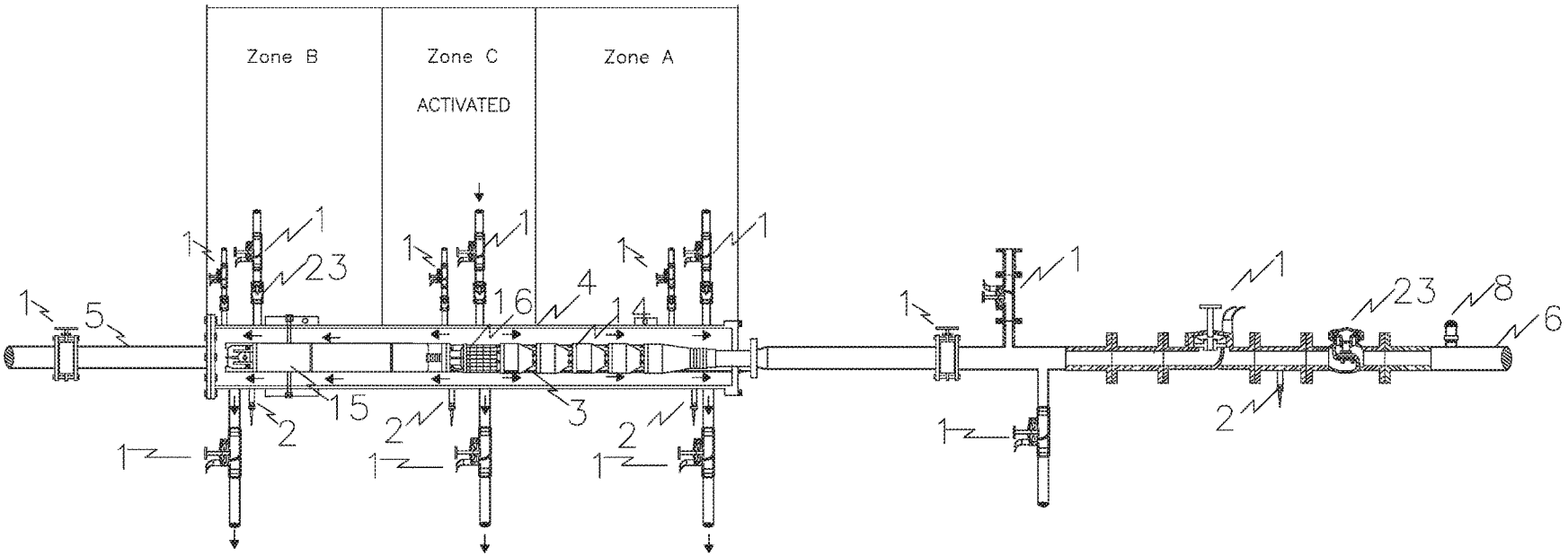

FIG. 29*c*, represents the first general stage of functioning of the cleaning system and considers the third washing, the zone C, central and suction filter.

Figure 29D:
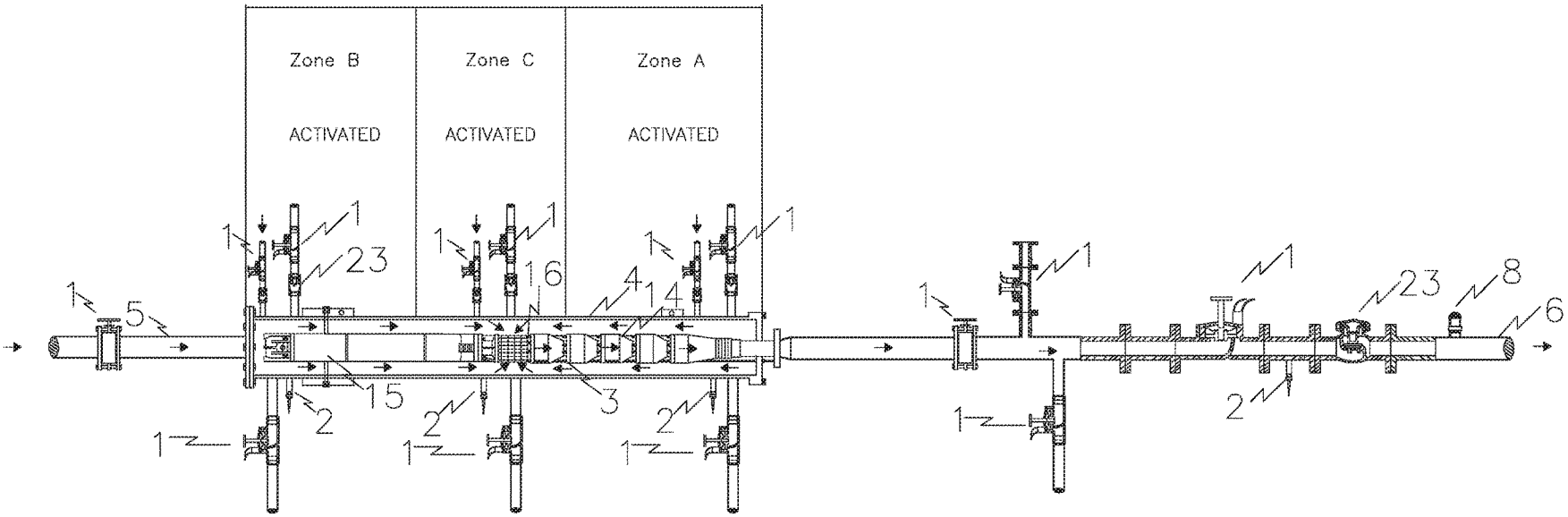

FIG. 29*d*, represents a second general stage, of cleaning compounds injection.

Figure 29E:
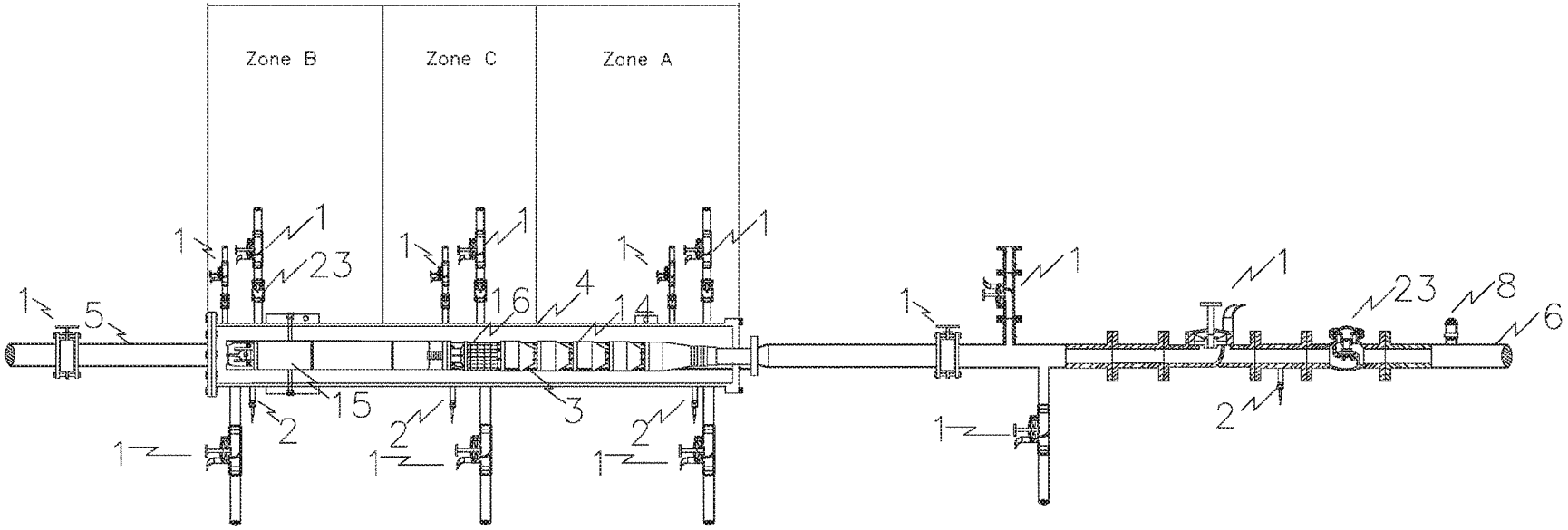

FIG. 29*e*, represents the third general stage, of soaking of cleaning compounds.

Figure 29F:
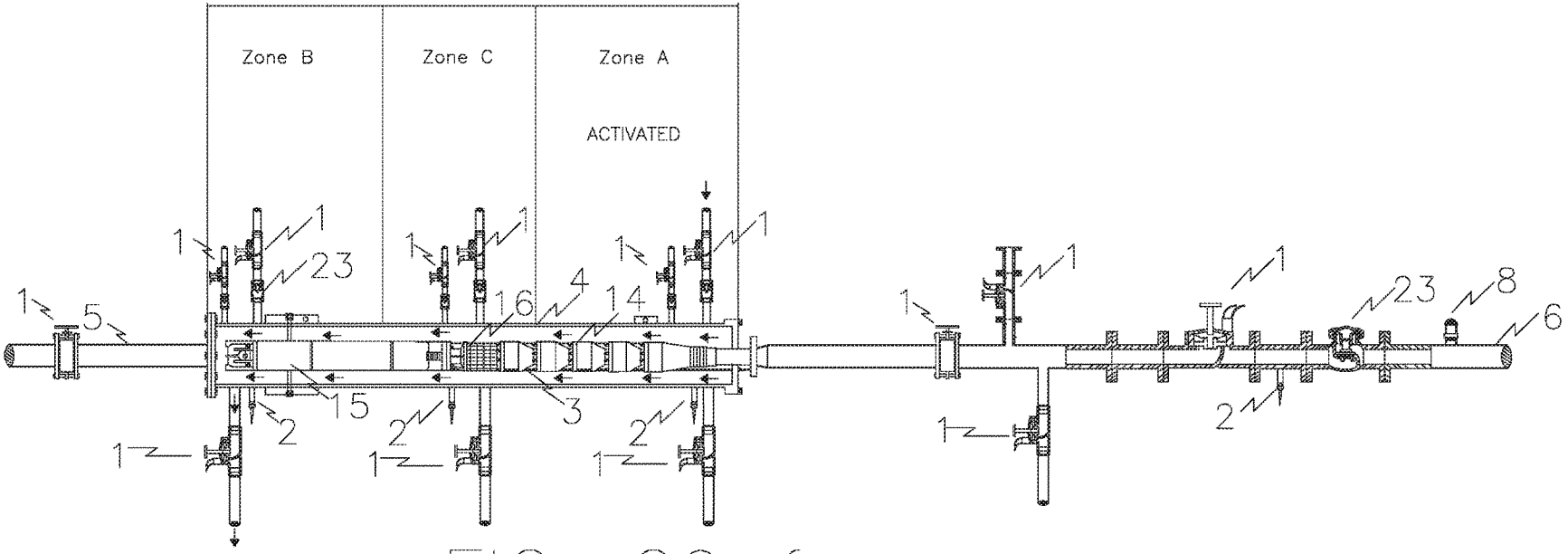

FIG. 29*f*, represents the fourth general stage, of removal and cleaning, wherein the removal of sediment and impurities which are strongly adhered to the surface of the various elements and parts that form the submersible motor pump as well as the inside of the suction sleeves which is in direct contact with water is performed. This figure represents the first washing, in the zone A of impellers.

Figure 29G:
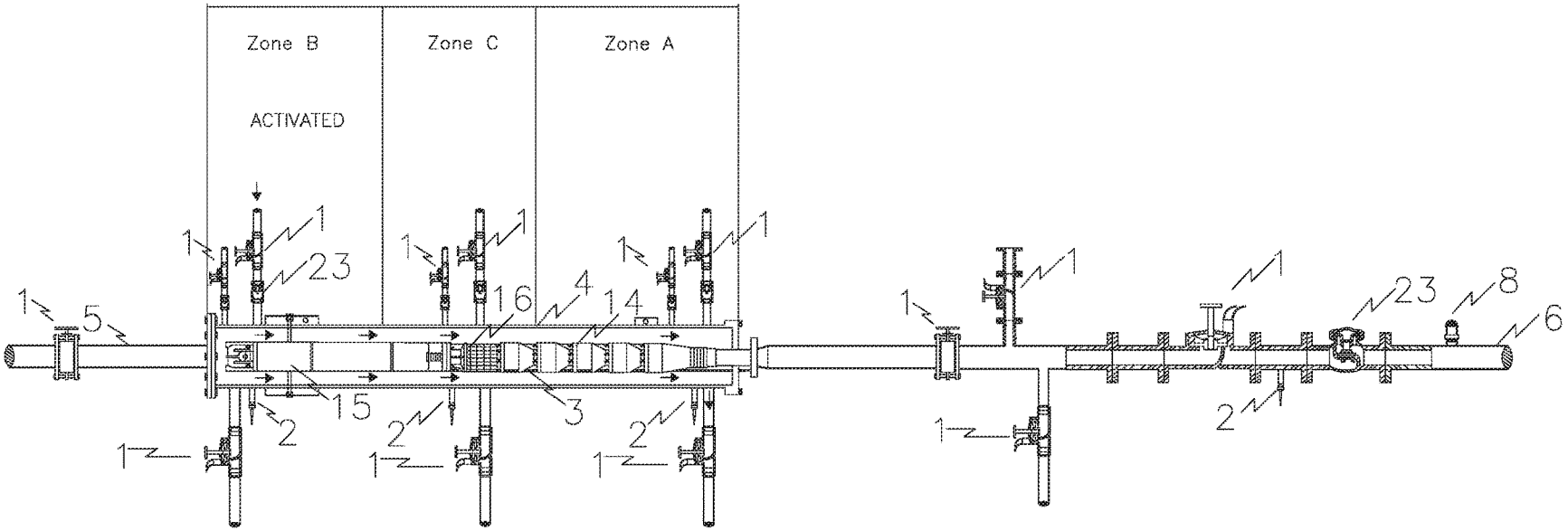

FIG. 29*g*, represents the fourth general stage of removal and cleaning and considers the second washing in the zone B of motor.

Figure 29H:
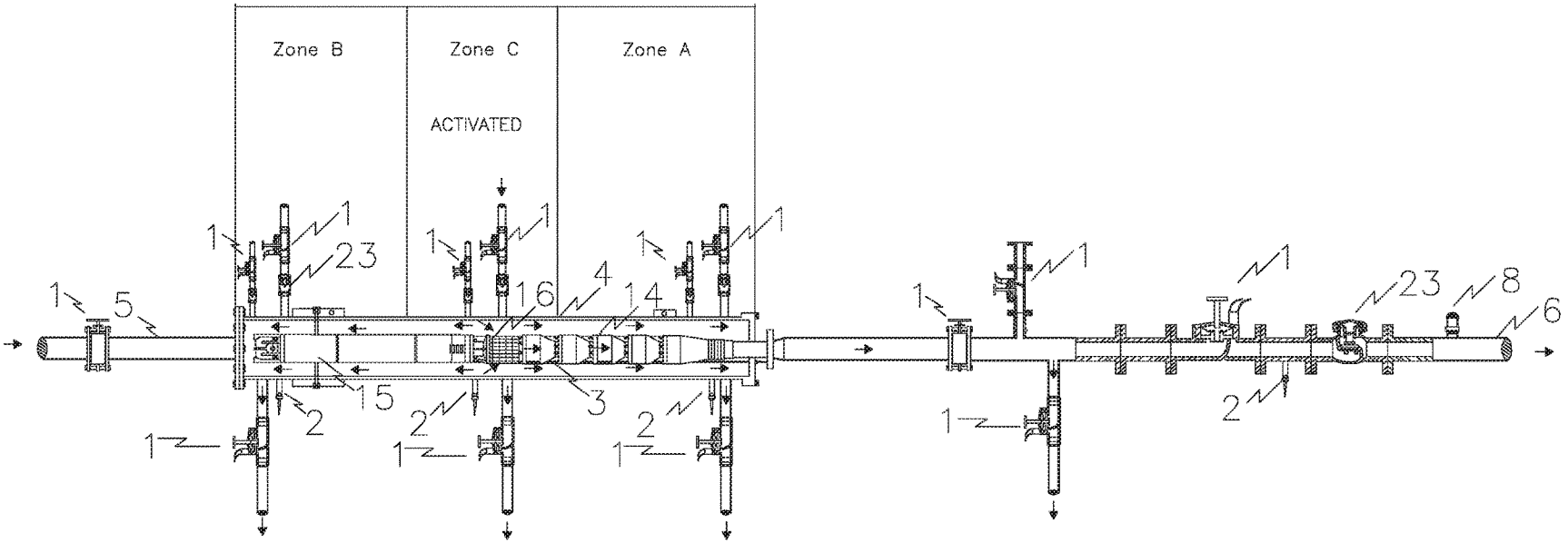

FIG. 29*h*, represents the fourth general stage, of removal and cleaning and considered the third and last washing, in zone C, central, suction filter.

Figure 29I:
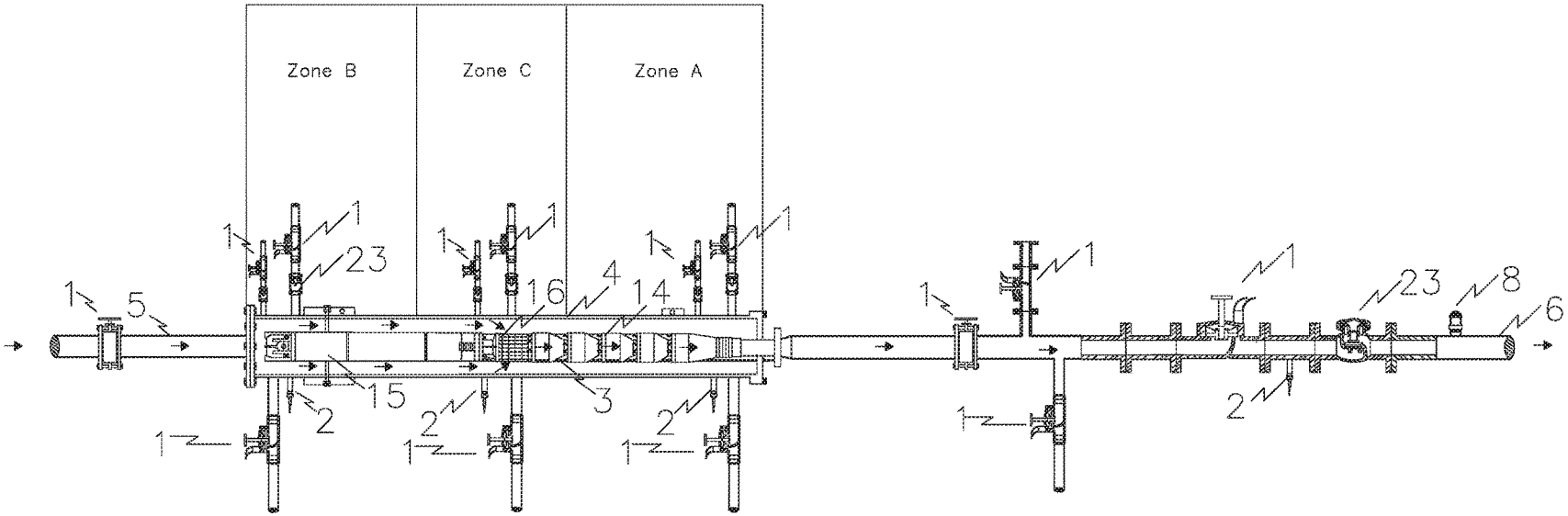

FIG. 29*i*, represents the fifth and last general stage of functioning of cleaning system for submersible motor pumps with suction sleeves, placed in vertical and horizontal form.

DETAILED DESCRIPTION OF THE INVENTION

The invention corresponds to a set of valves (1) and sensors (2) placed in several zones, in different spatial arrangement (FIG. 1, 2, 3, 4, 5, 6, 7), and in different places of the submersible motor pumps (3), covered with suction sleeves (4), arranged horizontally (FIG. 8, 9, 10) or vertically (FIG. 11).

The present invention consists in a cleaning system which provides basically a series of valves (1) of different types and operation, and sensors (2) which can be individual or multi-parametric, that is, on a single device may be disposed several sensors which detect or measure different parameters, for example, pressure, electrical conductivity, hardness, chlorine detectors, detergent, arranged in the three zones (FIG. 8, 11) of the submersible motor pumps (3), covered with suction sleeves (4). These zones are defined primarily as A, impeller zone (14), zone B, motor zone (15) and zone C, central, where the suction filter (16) is located. Valves and sensors are also located in the suction pipe (5) and discharge pipe (6).

Submersible pumps (3) are placed in horizontal (FIG. 8, 9, 10) form and vertical (FIG. 11) form, either above the ground or under the ground, within empty chambers without water (13) or with water in tanks (12) and with several horizontal variations (FIGS. 12, 13, 14, 15, 16, 17, 18, 19 and 29) and vertical (FIGS. 21, 22, 23, 24, 25 and 26) and combinations therefrom (FIG. 27 or FIG. 28).

Valves, sensors and constituents of the cleaning system are located on, by the sides, under in the flange (FIG. 10, 11, 21) of the suction sleeves (4) of submersible motor pumps (3), linearly, opposite, circular or helical shaped, surrounding suction sleeves and submersible motor pumps (FIG. 7).

The valves are part of the cleaning system for submersible motor pumps with suction sleeves, which can be of any type and actuation and are defined in four main constituent groups:

Group 1: defined as valves for clean water (1), because they allow the entrance of clean water, pressurized, to the suction sleeves (4) of submersible motor pumps (3).

Group 2: the valves that are used for injecting cleaning compounds (1). Normally are smaller than others valves (clean water and dirty water).

Group 3: contains valves that allow expelling of the dirty water (1), sediments and impurities adhered to the various components of submersible motor pumps, covered with suction shirts. These valves can generally be larger than the valves of the group 1 and 2.

Group 4: refers to valves (1) used to perform the function of cutting or water passing, located in the zone of suction pipes and discharge of the submersible motor pumps.

The valves that form the cleaning system of submersible motor pumps with suction sleeves, injecting compounds and water called clean (clean water of different sources and qualities) and pressurized by an external source, either of gravitational, manual or via attached motor pump origin or else, via another submersible motor pump (1) that accompanies (FIG. 27 or FIG. 28') to the submersible motor pump to clean and are generally disposed above and by the sides of the suction sleeves (4) and suction pipes (5) or discharge (6). The valves that expel water called dirty water, eliminate sediments, and impurities adhered to the surfaces of the impellers (14), motor (15), connecting elements (18) and support (17), manhole cover (7), air valves (8) and from the suction sleeves (4) of submersible motor pumps (3). These water valves are usually placed below suction sleeves (4) and discharge pipes (6), so that they receive all flow with dirty material.

In general, different types of valves (1) and sensors (2) maybe of different type and automatic, semi-automatic or manual functioning. Valves (1) have the function of entering water and different chemical compounds of cleaning action, encrusting and removal of elements; allowing exit and expulsion of dirty water, product of cleaning and releasing of sediments and impurities adhered to rotation bodies or impellers (14), connecting elements (18) and support (17) of the submersible motor pumps (3).

Individual or multi-parametric sensors (2), allow detection of different parameters or variables, such as pressure, turbidity, electrical conductivity, hardness, chemical compounds, etc. And once detected any determined variable or parameter, give the signal to occur the valve (1) opening or closure and stopping or running of annexed motor pumps, submersibles and accompanying, or injection devices of compounds.

Valves and sensors can be placed above, by the sides, below or on the flanges (21) of the suction sleeves (4) of submersible motor pumps (3). They can be placed directly with wire, welded or also using individual supply pipes (9), common pipes by zone (11), or general common cleaning pipe (10) in connection with suction sleeves (4) of submersible motor pumps (3). The vales and sensors can also be placed in the suction pipes (5) and discharge (6).

The valves that form the group 4 generally correspond to retention valves, foot valve, cut valves, placed at the entrance or suction pipes (5) and output or discharge pipe (6) of the suction sleeves (4), such that to retain the soaking time (detailed in FIG. 29 (*a, b, c, d, e, e, g, h, i*) of functioning), the chemical-cleaning compounds to act after, during releasing of the sediment and impurities present in the various parts of the submersible motor pumps and suction sleeves.

The actuation of the valve (1) is performed automatically or semi-automatic by external devices as boards, programmers, and the entry of pressurized water and cleaning compounds is effected by motor pumps attached or using special devices, for example, injection of cleaning compounds via venturi system, to the submersible motor pump system to be cleaned or, when there is more than one submersible motor pump, the accompanying submersible motor pump, as in the case of combinations (FIG. 27 or FIG. 28), between two or more cleaning systems provide the hydraulic force and impels the flow of water to the entrance thereof, to the suction sleeve (4) of the motor pump (3) being cleaned at the time and produce removing of all the dirty water, with sediments and impurities contained in the suction sleeve of the submersible motor pump to be cleaned.

There is also a manual alternative, using valves with such actuation type and there is a basic option of cleaning the submersible motor pump covered with suction sleeve, by placing an external hose, connected to the ball valve (19) (or gate valve), which is located in the center of the manhole cover (7) of accompanying submersible (3) motor pump. Incorporating cleaning chemicals is done by removing the manhole cover (7), previous drain of water contained in the suction sleeve (4) of submersible motor pump to be cleaned.

The dimensions and vales quantity and sensors that intervene in the cleaning system are diverse and varies with the capacity of each submersible motor pump, covered with suction sleeves. Also, the suction sleeves also vary on their dimensions depending on the length and diameter of the submersible motor pump used. Thus, the cleaning system of the submersible motor pumps is basically related with the dimensions of the submersible pump and with the volume of the suction sleeve used.

Thus, the length of a submersible motor pump can vary between 0.3 to 5 meters or more and its diameter can vary from 50 mm. to 600 mm. or more. Therefore, dimensions of suction sleeves also vary. It maybe, for example, suction sleeves volumes from 5 to 1500 liters. Therefore, the automatic or manual cleaning system of submersible motor pumps, may operate with valves of different diameter. Generally, operating with diameters between 20 to 110 mm or more.

In the FIGS. 1, 2, 3, 4, 5, 6 and 7, a breakdown of the basic spatial arrangement is shown, in which the valves are located and sensors, in suction sleeves of submersible motor pumps.

Figure 1:
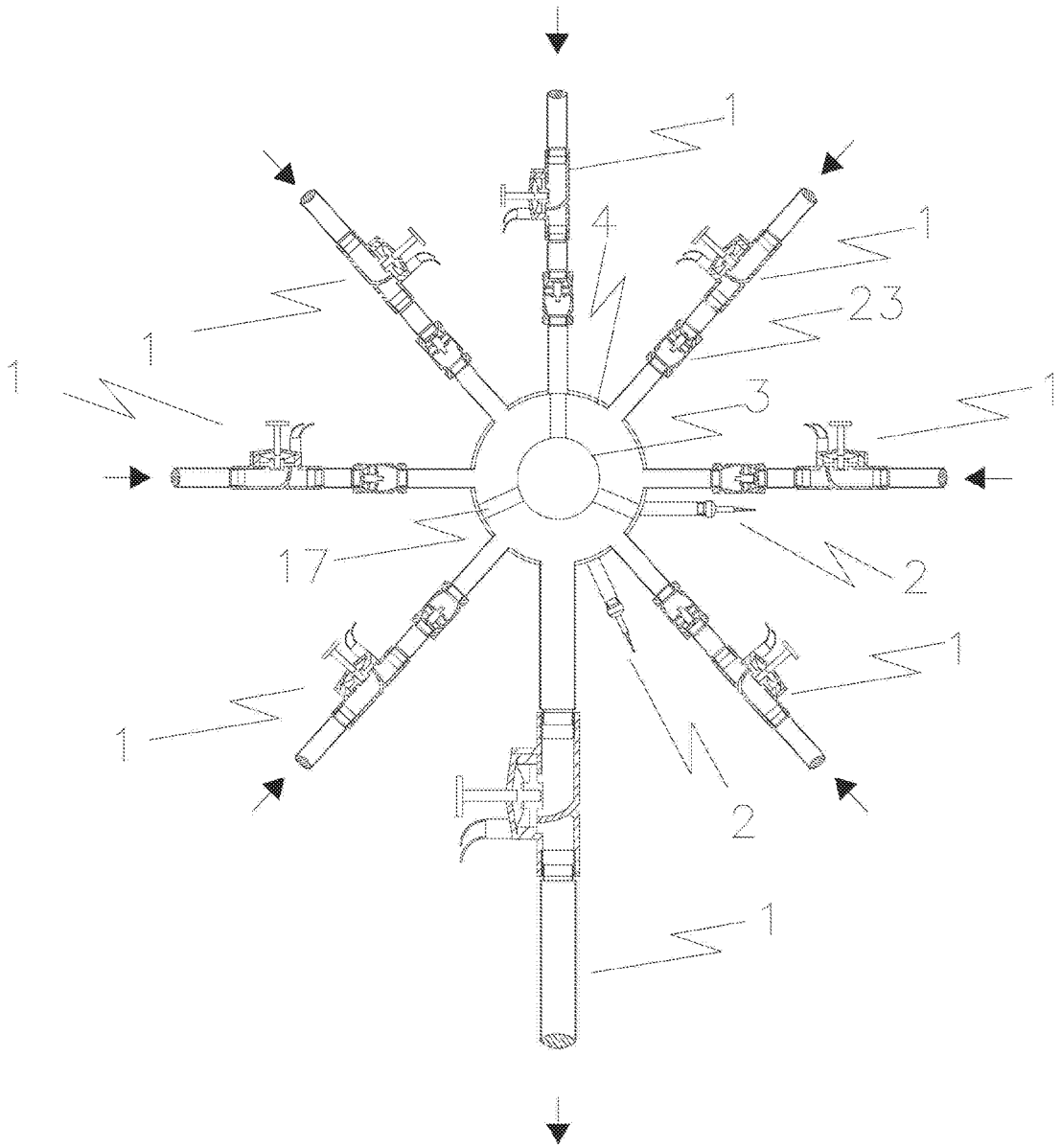
FIG. 1, shows the arrangement of the valves and sensors connected directly to the suction sleeve of submersible motor pump.

In FIG. 1 it can be observed multi-parametric sensors (2) and individual valves (1) for clean water, dirty water, cleaning compounds and dual purpose valves, that is, a single valve (1) can be used for more than a function, arranged directly to the suction sleeve (4) of submersible motor pump (3).

Figure 2:
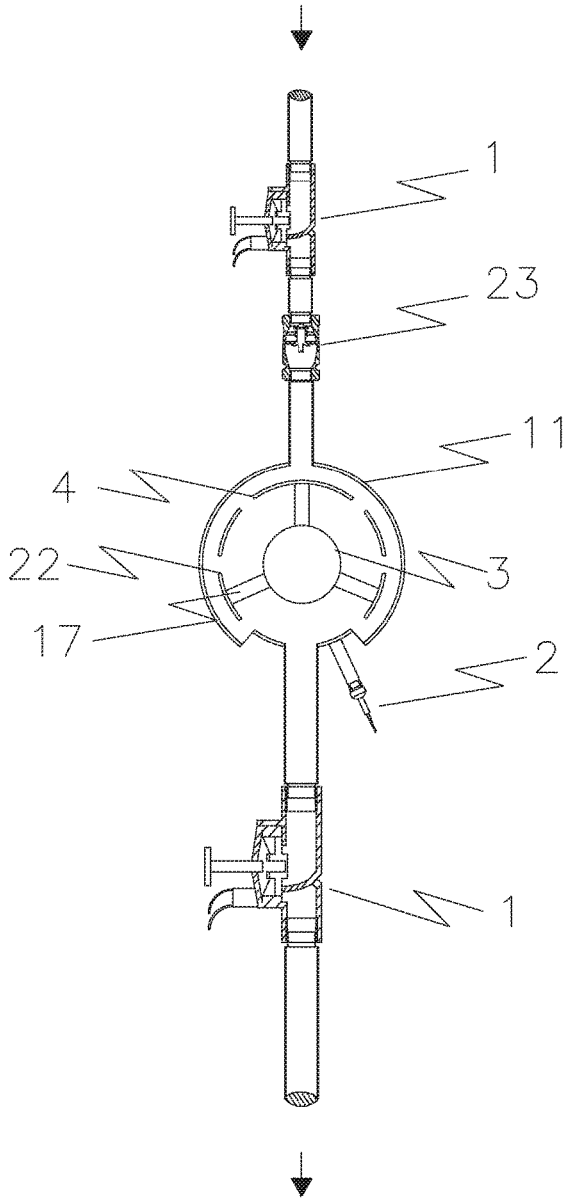
FIG. 2, shows dual purpose valves connected to a common pipe by zone. Multi-parametric sensor is located under the suction sleeve and support of submersible motor pump is observed.

In the FIG. 2, dual-purpose valves (1) connected to a common pipe by zone (11) arranged around the suction sleeve (4) of the submersible motor pump (3) are observed. The multi-parametric sensors (2) are placed under the suction sleeve (4) of submersible motor pump (3). The support (17) of the submersible motor pump, welded to the inner surface (22) of the suction sleeve can be seen.

Figure 3:
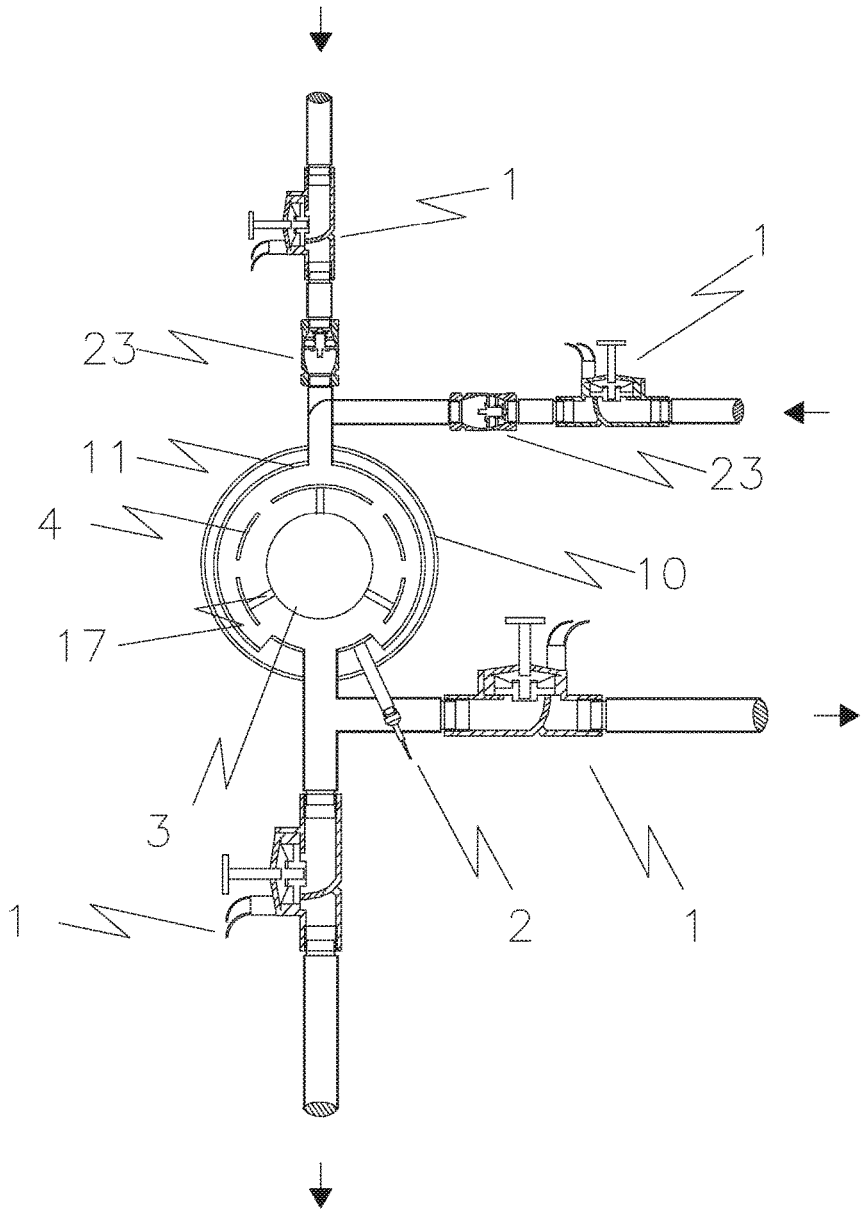
FIG. 3, represents the valves with dual purpose, connected in the interior of a common general cleaning pipe connected to a common pipe according to cleaning zone. The dirty water valve, located below the suction sleeve, has vertical and lateral guidance.

In the FIG. 3 dual purpose valves (1) are observed, placed within a general common cleaning pipe (10), covering the submersible pump (3) and the suction sleeve (4) and connected to a common line by zone (11). Also, dirty water valve (1) is observed, located below the suction sleeve with either lateral or vertical orientation.

Figure 4:
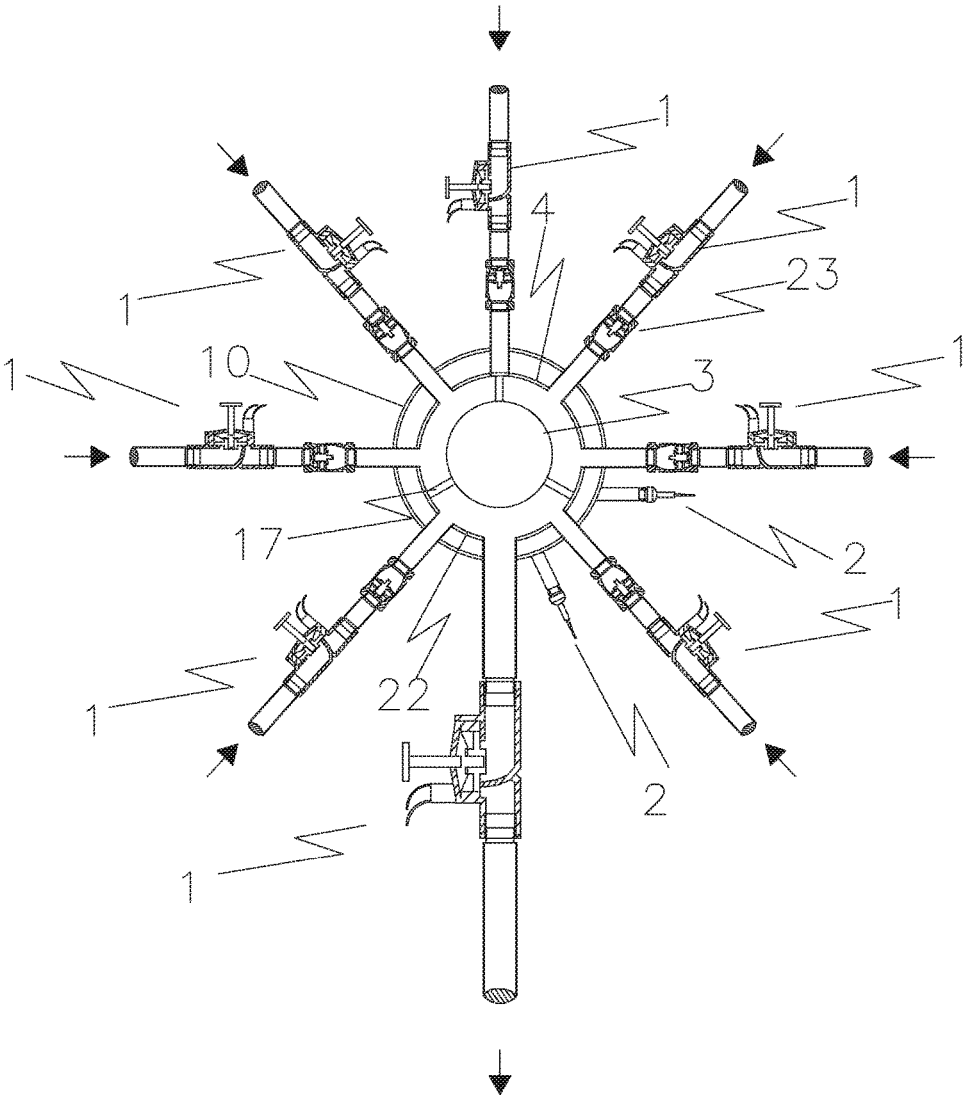
FIG. 4, represents the individual or dual purpose valves, which are placed within a general common cleaning pipe, which covers the suction sleeve and the submersible motor pump. The sensors are below or on sides of the suction sleeve.

In FIG. 4, single (1) and dual-purpose valves (1) are observed, placed within a general common cleaning pipe (10), covering the submersible pump (3) and suction sleeve (4) and connected directly to the suction sleeve. The multi-parametric sensors (2) are placed below or by the side of the suction sleeve (4).

Figure 5:
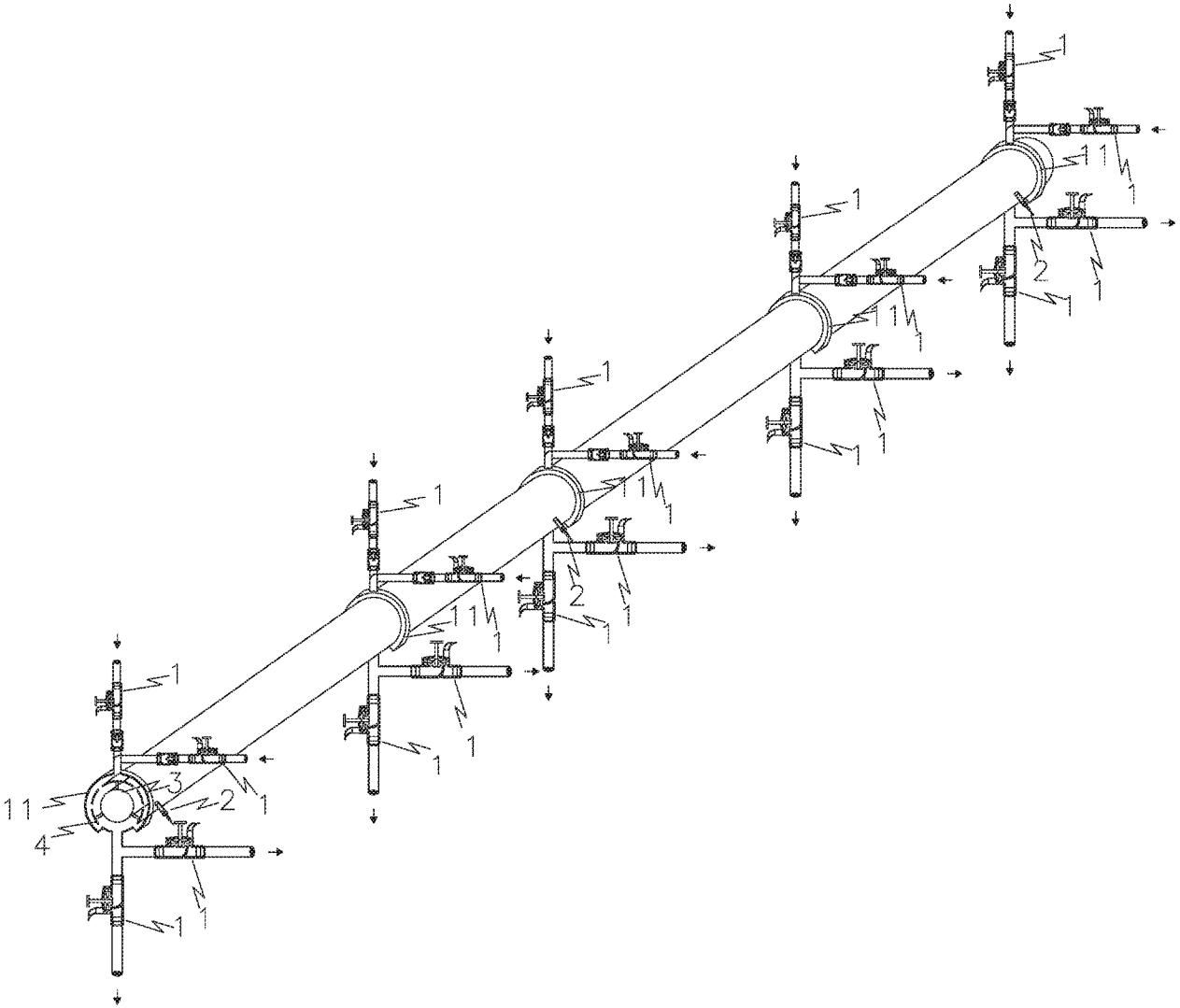
FIG. 5, shows in perspective the arrangement of dual-purpose valves connected to pipes according zone and is observed two sets of valves in areas A, impellers, and area 13, motor.

In FIG. 5, it can be observed that can be placed more than one clean water valve (1), of cleaning compounds (1) and dirty water (1) in each of the cleaning zones of the submersible motor pump. Here, two sets of valves, located in the zones of impellers (zone A) and motor zone (zone 13) are presented. In the center (zone C) we have only one set of valves. Multi-parametric sensors are below or at side of the suction sleeve.

In FIG. 6, it can be seen locations of cleaning valves, with general common cleaning pipe (10). It is observed only a set, corresponding to the minimum capacity, of valves per zone.

In the FIG. 7 it can be observed four ways of placing cleaning valves (1) (to clean water, cleaning compounds and dirty water) in each of three zones of submersible motor pump with its suction sleeve. The arrangement may be lineal, circular, opposite and helical. In the linear arrangement is established the same direction from one end to another, of the submersible motor pump; in the circular arrangement the valves (1) surrounding the submersible motor pump (3) are presented, with its suction sleeve (4), the opposite arrangement corresponds to the valves being located up-down, left side-right side and diagonal upper-diagonal lower; and finally, the helical arrangement corresponds to the valves forming curves that are rotating on the surface of the suction sleeve of the submersible motor pump. Multi-parametric or individual sensors (2) can be placed under or by the sides of the suction sleeve (4).

In FIGS. 8, 9 and 10, the general arrangement of the valves and sensors for the cleaning system of submersible motor pumps is observed, depending on how they are placed. In this case, with horizontal arrangement. And in FIG. 11, the vertical arrangement is shown In FIG. 8, it can be observed the cleaning system with minimum capacity of sensors (2) and valves (1), connected directly to common pipes by cleaning zone (11), to the suction sleeve (4) of the submersible motor pump (3), using manhole cover (7) and air valve (8) on it. The mounting is horizontal.

In FIG. 9, it can be observed the cleaning system with sensors (2) and valves (1), connected directly and with a common pipe by cleaning zone (11) to the suction sleeve (4) of the submersible motor pump (3), which does not have manhole cover and is placed horizontally.

In FIG. 11, it can be observed the cleaning system, considering individual valves (1), connected directly to the suction sleeve (4) of the submersible motor pump (3), which does not have manhole cover (7) and placed in horizontal form, inside an empty chamber (13), without water.

In FIG. 11, it can be observed the cleaning system with a maximum capacity of individual valves (1), connected directly to the suction sleeve (4) and the discharge pipe (6) of submersible motor pump (3) placed vertically. The multi-parametric and individual sensors (2) can be located on the sides and flanges (21) of the suction sleeve (4), as also in the area of discharge (6).

Variants

In the FIGS. 12, 13, 14, 15, 16, 17, 18, 19 and 20 are shown some of the major variants of the cleaning system for submersible motor pumps with suction sleeves, arranged horizontally and in FIGS. 21, 22, 23, 24, 25 and 26, are shown variants positioned vertically.

Horizontal Variations

In the FIG. 12, a variant of the cleaning system can be observed, consisting of valves (1) for clean water, cleaning compounds and for dirty water (under the submersible motor pump (3), with suction sleeve (4), placed on the outside of tanks with water (12) on the surface and connected by individual pipes (9), which converge toward a general common cleaning pipe (10), which may be mounted above, below or at a side of the suction sleeve (4) of the submersible motor pump (3) placed horizontally. The sensors (2) can be located on the sides of the suction sleeve.

In the FIG. 13 is observed a variant of the cleaning system, comprising valves (1) for clean water, cleaning compounds, dirty water, placed inside the general common cleaning pipes (10) which may be mounted above, below or at a side of the suction sleeve (4) of the submersible motor pump (3), which is placed in horizontal form inside tanks with water (12). The multi-parametrics sensors (2) can be located on the sides of the suction sleeve.

In the FIG. 14 is presented a variant of the cleaning system for submersible motor pumps (3), with suction sleeves, disposed in horizontal form, in a height, and above the ground, with horizontal discharge, in series. In this case, the valves (1) are placed inside general common cleaning pipe (10), which can be mounted above or under the suction sleeve (4) of the submersible motor pump (3), which is horizontally placed. Multi-parametric sensors (2) can be located below or on the sides of the suction sleeve and in the discharge pipe (6).

Another horizontal variant is represented by FIG. 15, wherein the cleaning system, where is considered that the motor pumps (3) are arranged in a horizontal form, in the interior of empty chambers (13) and possessing manhole cover (7). Here, we have (1) valves for clean water, dirty water and cleaning compounds, arranged outside the suction sleeve of the submersible motor pump. It is contemplated for dirty water valves, outlet and drain inside the empty chambers (13).

In the FIG. 16, the cleaning system is represented, considering the submersible motor pumps (3) located in the interior of empty chambers (13) and having manhole cover (7) and having inner valves (1) placed in general common cleaning pipes (10) and located above or under the suction sleeve (4) of the submersible motor pump. The mounting is horizontal.

In FIG. 17 it is represented one or more submersible motor pumps located above the ground with horizontal discharge in series. Here is observed the cleaning system, with disposition of external valves (1), with outlet and drainage below ground. The cleaning of the submersible motor pump (3) to be cleaned is made with external force, pumping with attached pump(s); gravitationally or manually.

The FIG. 18 represents one or more submersible motor pumps, located above the ground, with horizontal discharge and bypass. This figure corresponds to the cleaning system, disposed with inner valves (1), placed in general common cleaning pipes (10) and placed above or under the suction sleeve of the submersible motor pump. Cleaning of the motor pump to be cleaned is performed with external force, pumping with attached pump(s); gravitationally or manually.

FIG. 19 corresponds to the variant of a one or more submersible motor pumps with suction sleeve, located above the ground, with horizontal discharge and bypass. This variant represents a single cleaning system with minimum capacity of individual external valves (1), connected directly, above, under and flanges (21) of the suction sleeve (4) of the submersible motor pump (3). The cleaning of the motor pump to be cleaned is performed with external force, pumping with attached pump(s); gravitationally or manually.

In FIG. 20 is represented one or more submersible motor pumps, located inside tanks with water (12) and having foot valve (1). This figure represents the cleaning system, considering inner valves (1) placed on the surface and connections located on general common cleaning pipes (10), until arriving to the suction sleeve (4) of the submersible motor pump (3). The cleaning pump to be cleaned is performed with external force, pumping with attached pump(s); gravitationally or manually.

Vertical Variations

In the FIG. 21 is observed a variant of the cleaning system, consisting of valves (1) for clean water, cleaning compounds and for dirty water, positioned outside the tank with water (12) and directly connected by individual pipes (9), placed on the sides of the suction sleeve (4) of the submersible motor pump (3), which is placed vertically on the inside of the tank with water (12). The multi-parametric sensors (2) can be located on the sides of the suction sleeve (4).

In the FIG. 22 it is shown a variant of the cleaning system, considering valves (1) for clean water, cleaning compounds and dirty water, positioned inside general common cleaning pipes (10) and placed inside the tank with water (12) and, like the multi-parametric sensors (2), by the sides of the suction sleeve (4) of the submersible pump (3), which is placed vertically inside the tank with water (12).

FIG. 23 depicts one or more submersible motor pumps (3), placed inside suction sleeves (4) or water pipes (called generally in that way, vertically arranged) and placed above the ground, with vertical discharge in series. In this case, a cleaning system variant is present, considering external valves (1), placed by the sides of the suction sleeve of the submersible motor pump. Cleaning the motor pump to be cleaned is made with external force, pumping with attached pump(s); gravitationally or manually.

In FIG. 24 is represented one or more submersible motor pumps (3), placed inside suction sleeves or pipes with water and placed above the ground, with vertical discharge in series. Here is shown the cleaning system, considering inner valves (1), placed inside general common cleaning pipes (10) and located by the sides of the suction sleeve (4) of the submersible motor pump. Cleaning the motor pump to be cleaned is made with external force, pumping with attached pump(s); gravitationally or manually.

The FIG. 25 represents one or more submersible motor pumps (3), placed inside the suction sleeves (4) and placed above the ground, with vertical discharge with bypass.

Here, a variant of the cleaning system is presented, considering external valves (1), placed by the sides of the suction sleeve of the submersible motor pump. Cleaning of the motor pump to be cleaned is performed with external force, pumping with attached pump(s); gravitationally or manually.

Like the previous figure, FIG. 26 also represents the group of one or more submersible motor pumps, placed inside suction sleeve and placed above the ground, with vertical discharge, with bypass. But here on the variant, the cleaning system is observed considering inner valves placed inside general common cleaning pipes (10) and located by the sides of the suction sleeve of the submersible motor pump.

Cleaning of the motor pump to be cleaned is performed with external force, pumping with attached pump(s); gravitationally or manually.

Combinations of the Cleaning System.

In the cleaning system for submersible pumps, covered with suction sleeves, the application of clean water and cleaning compounds and the outlet of dirty water is performed by an external force, with an annexed attached pump(s), gravitational force, either manually or by another submersible motor pump accompanying the submersible motor pump to be cleaned and vice versa. In the latter case, it is taken for example, when operating with two or more submersible motor pumps, covered with suction sleeves and with different variants or forms of the cleaning system which are in combination one with others. Because a large number of combinations can be performed between the different forms or variants of the cleaning system, on FIG. 27 and FIG. 28 only two combinations of the invention of the submersible motor pumps, with suction sleeves arranged horizontally and vertically, respectively, are shown.

In the FIG. 27, a combination of the cleaning system, between external valves (1), placed on the surface and in individual pipe connections (9) is observed, until reaching the suction sleeves (4) of the submersible motor pumps (3) and inner valves (1), placed in general common cleaning pipes (10) located above or under suction sleeves of the submersible motor pumps, which are arranged in a horizontal form. Cleaning the motor pump to be cleaned is done with the accompanying submersible pump (3) and vice versa.

The FIG. 28 represents one or more submersible motor pumps (3), placed inside sleeves or pipes with water (4) and placed above the ground, with vertical discharge in series. This figure corresponds to the combination of the cleaning system, including external valves (1), placed by the sides of the suction sleeves of the submersible motor pumps and inner valves (1), placed inside general common cleaning pipes (10) and located by the sides of suction sleeves of the submersible motor pumps. Cleaning of the motor pump to be cleaned is performed with the accompanying submersible motor pump (3) and vice versa.

Operation Scheme of the Cleaning System for Submersible Motor Pumps with Suction Slevees Placed in Horizontal or Vertical Form.

In FIG. 29 (*a, b, c, d, e, f, g, h, i*) the operating diagram of the cleaning system is broken, for submersible motor pumps with suction sleeves (or also called water pipes, in the case of submersible motor pumps, placed vertically) placed horizontally or vertically, consisting basically on applying clean water (called arbitrarily clean, meaning that that the water contains lower amounts of sediments and impurities compared to the water to exit after cleaning of the submersible motor pump and its suction sleeve), pressurized and cleaning compounds, also pressured and to expel dirty water (water with sediments and impurities adhered on the surface or inner surface (22) of the suction sleeve and on the various components in contact with the water of the submersible motor pumps (3). This, after performing cleaning of the submersible motor pump through valves and sensors of various types and actuation in three zones of submersible motor pumps, called zone A of impellers (14), zone B of motor (15) and zone C (central) of suction filter (16). It is applied water and cleaning compounds, pressurized by external force, pumping with attached pumps(s), gravitationally or manually or else, through another submersible motor pump which accompanies the submersible motor pump to be cleaned and vice versa.

In this three areas, it is applied the water, and cleaning compounds in five (5) stages: the first general stage is to clean sediments and impurities which are adhered to the surface layers of the various elements and parts which comprise the submersible motor pump and also inner surface (22) of the suction sleeve, which is in direct contact with water.

This first general stage consists of the first washing, zone A, impellers, FIG. 29*a*; second washing, zone B, motor, FIG. 29*b* and a third washing, zone C, central, FIG. 29*c*.

Then comes a second general stage consisting of injection of cleaning compounds (detergent, bleach, disincrustant, etc.), shown in FIG. 29*d*.

Then, the third general stage enters, of soaking cleaning compounds represented by FIG. 29*e*.

Then comes the fourth general stage, of removal and cleaning (FIG. 29 *f, g, h*), where is performed the removal of sediments and impurities strongly attached on deep layers of the surface of the various elements and parts forming the submersible motor pump and also the inner surface of the suction sleeve, which is in direct enjoyed the water.

In this fourth stage of removal and cleaning, the cleaning cycle of the three zones is performed again. Therefore, the same sequence of the first three washings, that is, the fourth general stage is comprised of the first washing of zone A, impellers, FIG. 29*f*; second washing, zone B, motor, FIG. 29*g* and third and last washing, zone C, central, FIG. 29*h*.

The fifth and final general stage corresponds to the end of the cleaning process, represented by FIG. 29*i*.

Each stage and cycle of the cleaning process can take several minutes, depending on different variables, such as the quantity of sediments and impurities deposited and adhered on the surface of the elements of the submersible motor pump that are in direct contact with water flow and the inner of the suction sleeve, also varies over time from the last washing or cleaning, the amount of sediments and impurities coming from the water source, the season in which that water is being pumped, by being water from river, usually in times of thaws during summer, the amount of sediments increases greatly due to melting ice.

In general, the greater the amount of sediment and impurities that are present in the water, the longer the time elapsed since last washing of cleaning, the longer the time of normal flow, i.e. from the motor zone to the impellers zone and reverse flow backwashing, i.e. from the zone of the impellers to the motor area.

The latter is crucial, since in the zone A of impellers, between the inner surface of suction sleeve (22) and submersible motor pump (3), during operation of the motor pump, there is virtually no movement of the water flow and generally starts to accumulate large amounts of sediment and impurities present in the impelled water. As time passes, the accumulation of sediments and impurities is large and very compact, this is particularly evident in submersible motor pumps placed horizontally. With the continuous flow and movement of water entering or the pump, they fall off form that zone sediments and dense impurities which hinder the normal flow of impelled water and adheres (in addition to sediment particles and impurities suspended in the water) strongly to all fixed and moving parts of the submersible motor pump, which are in contact with water. This produces jams and premature wearing of the components, whereby the normal and proper operation of the submersible motor pump becomes difficult.

Therefore, the operation of this cleaning system for submersible motor pumps, covered with suction sleeves has a single operation scheme. This means that is not enough to place a series of valve and sensors disposed above, by the sides or below suction sleeves and to submit submersible motor pumps to a cleaning, based on water applications and injections of cleaning compounds using pressure and remove the dirty water. The fundamental in this is precisely to produce reverse flow water or backwashing of water entering the clean water valves, starting the pressurized water ingress in zone A of impellers, where there is practically no movement or flow of the water that is impelled. This zone A of impellers is the critical zone for it to start and run a deep cleaning of submersible motor pumps covered with suction sleeves, especially in horizontal disposition since strongly acts the action of gravity in depositing sediments and impurities.

The pressure for opening and closing the valves for clean water, cleaning compounds and dirty water, can be provided by an external force, either in the form gravitational force, by height difference, manually or through the use of one or more annexed pumps attached to the cleaning system.

On the other hand, when there are different combinations (FIG. 27, FIG. 28), of the cleaning system or between multiple submersible motor pumps with suction sleeves, which are in operation and close one each other, it is relied on the accompanying submersible motor pumps (FIG. 27, FIG. 28), which have valves for clean water (1), located on the discharge pipes (6) and through these valves pressurized water is provided to operate all valve system, particularly, the valves used for clean water and for injection of cleaning compounds. It is also to be mentioned that for the injection of cleaning compounds, in the case of using an accompanying submersible motor pump, one must rely to one injection system with a device, which by differential pressure, for example a venturi, allows the entrance of cleaning compounds to the cleaning system.

In the cleaning systems for submersible motor pumps, with suction sleeves, when external force is used, generally one or two valves for clean water (1), placed in the discharge pipe (6) are used. And, in the case that the cleaning systems use accompanying submersible motor pumps, usually can be used two types of valves for clean water (1) and distinct connection between them, arranged in the discharge pipes (6). Thus we have a valve with wire or welded to the discharge pipe and other, coupled with flanges. This combination is to have more versatility in terms of ways to connect with each other, at the time of cleaning of submersible pumps with suction sleeves.

In general, for the cleaning system to work properly and to allow the removal of sediments and impurities adhering to the surface of the various elements of the submersible pump, with its suction shirt and which is in direct contact with the water there must exist a minimum pressure of at least two bar. In the case of pressures over 10 bar, the individual multi-parametric sensors, are accompanied by valves (23) of gate or pressure regulation.

On the other hand, the individual or multi-parametric sensor disposed in different parts of the suction sleeve (4) and discharge lines (6) have the function of detecting the presence of injected cleaning compounds, such as chlorine, detergents, descaling compounds, organic and inorganic, turbidity detection, pressure, electrical conductivity and hardness. Once the sensors detect the different variables or parameters, they send the signal to be performed automatically or semi-automatic the operation of the valves. In the case manual operation, the sensors signal can be measured or visually observed, so as to allow manually operation of the various valves.

Another important aspect to mention is in relation to the injection of cleaning compounds, which takes little time, generally some seconds to a few minutes, according to the applied dose and the flow rate of the motor pump used, such as that they are mixed with all the circulating water and reaches every corner of the suction sleeve (4) and the impellers (14), filter (16), support for the submersible motor pump (17), motor (15) and connecting elements (18) of the submersible motor pump that is in direct contact with the water flow.

The dose of each chemical cleaning compounds to be injected, varies fundamentally according to water quality, the amount of sediments and impurities contained in the pumped water, the volume used by submersible motor pump with its suction sleeve and, on the other hand, the temperature at which it is pumping.

An example of application dose is in the agricultural area, for pumping river water, pre-filtered, medium hardness, ambient temperature, medium sediments and impurities, apply for a volume of 40 liters of water inside a suction sleeve for a submersible motor pump of 10 HP, a 0.5 liters of chlorine volume, with commercial concentration of 10%, plus 0.125 liters of detergent, during soaking time of 10 minutes. The injection dose time or cleaning compounds dose applied with an external pump with a flow rate of, for example, 20 liters per minute is, in this case, 2 minutes.

In the automatic case, the applied dose is directly related with the injection time. This time of injection, which is in direct relation with applied dosage should be calculated in advance, several times and measured in real field testing, prior to general cycle of functioning of manual cleaning of submersible pumps. For this, the determination of the tome of injection of cleaning compounds is achieved by manually measuring and detecting these elements with the aid of manual, automatic, multi-parametric or individual sensors, located in the zones A, B and C, of the suction sleeve (4) and discharge pipe (6). These sensor devices are responsible of detecting the presence of these compounds, throughout disseminated in the entire suction sleeve. Thus, a pattern and determination of the time of injection of compounds under a certain condition is obtained. Subsequently, is only required the injection of compounds with the preset time, ensuring accurate application of the compounds in real time.

For soaking-cleaning compounds (FIG. 29*e*), it is required a time that is variable, for example, a soak time from 10 to 20 minutes, depending on each case, but generally, when the water pumped is of poor quality, with greater presence of sediments and impurities, relative to a better water pumping, i.e. with less sediment and impurities, the permanence or soaking time is greater.

Furthermore, this soaking time is previously determined, visually and with qualitative analysis as to observe absence of damage in the inner electrical wiring (20) and the presence of sediments and impurities attached to the surface of the impellers (14), connecting elements (18) and support (17) of the submersible motor pump (3).

Having secured this, i.e. the internal electrical wiring (20) of the submersible motor pump (3) is in good condition, as are the impellers (14), elements of connection (18) and support (17) in good condition and complete release of sediments and impurities adhering to the surface or walls of the mentioned elements is determined the permanence of soaking time of the cleaning chemicals compounds.

Generally, as noted above, when the water pumped comes from a source with higher sediments and impurities, the soaking time should be increased and vice versa. It also happens that with increasing temperature of some process, the incrusting force is increased and therefore, the soaking time should also be higher such as in boilers.

During the removal and cleaning stage (FIG. 29 *f, g, h*) of sediments and impurities strongly adhered or incrusted to the submersible motor pump and to the suction sleeve, has a variable time, which can range, for example, between 1 to 5 minutes in the case of a pre-filtered river water pumping, at room temperature under medium hardness (100-180 ppm) and sediment and impurities of medium amounts (measured with the electrical conductivity parameter, 1000-1500 micro Siemens/meter.) This time is previously determined manually, depending basically on the dimensions of the pump and its suction sleeve as well as the time elapsed since the last washing or cleaning of the submersible motor pump and most importantly, is the variable of quality and quantity of sediment and impurities from the water supply. Thus, the longer the time elapsed between a cleaning and other and the worse the water quality, as the quantity of sediments and impurities, the longer the time of removal and cleaning of sediments and impurities, adhered to the submersible motor pump and its suction sleeve.

The cleaning compounds used can be commercial Sodium Hyperchlorite of high and low concentration, phosphoric acid, disincrustant, commercial or industrial detergents, etc.

Following is the explanation of each functioning stage of the cleaning system.

In the FIG. 29*a* is depicted the first general stage comprised by the first washing, zone A, impellers, activated. The submersible motor pump (3) is stopped and the valves (1), located in suction pipes (5) and discharge (6), closed. With the active external force, i.e. of gravitational, manual type or attached pump running or when there is another accompanying submersible motor pump. In this case, the valve can be used for clean water (1), located on the discharge pipe (6) of the accompanying submersible pump (3) for actuating and allowing flowing of pressurized water through valves for clean water (1), placed on the suction sleeve (4) of the submersible motor pump (3). Then, the valve for clean water (1) is opened, located on the suction sleeve and dirty water (1), located below suction sleeve (4) of the submersible motor pump (3). The reverse flow of water or backwashing occurs from zone A, from impellers (14) towards (14) to area B of motor (15). Then, the valves for clean water (1) of zone A and the valves for dirty water of zone B are closed.

FIG. 29*b* represents the second washing, zone B, motor activated. Clean water valves (1), in the zone B and dirty water, zone A, are opened. Normal water flow occurs, i.e. from zone B, from the motor to the zone A of the impellers. Then the valves of clean and dirty water are closed, which were mentioned above.

In the FIG. 29*c* is observed the third washing, zone C, central, activated. Clean water valves in the area C and dirty water, Zone A, are opened (also are opened the valves for dirty water (1) of the central zone C, depending on the dirt that exists in said zone, i.e. if there is large amounts of sediments and impurities in that zone C, then proceed with the aperture of the valves for dirty water of the zone). Normal and reverse or backwashing flow occurs from the center to the zone A of the impellers (14) and from the center to the zone B of motor (15), respectively. Then, the valves for clean water (1) of the central zone, valves for dirty water (1) in zones A, B and C are closed. External force stops.

Next comes a second general stage in which proceed to perform the injection of cleaning compounds (detergents, chlorine, disincrustant, etc.), shown in FIG. 29*d*. At this stage of injection of cleaning compounds, zones A, B and C, are activated. Valves (1) are opened, located on suction pipes (5) and discharge (6). It is started the submersible motor pump (3) and the external force actives (gravitational, manually or with running annexed motor pump) or else, the accompanying submersible motor pump. Cleaning compounds valves (1) are opened, of lower size relative to the clean water valves, and placed in the three zones A, B, and C on the suction sleeve of the submersible motor pump (3). Then, when the multi-parametric sensors (2) detect the presence of chemicals, the signal is given so that the submersible pump (3) stops. Then close the valves (1) located on the suction (5) and discharge (6) pipes and the external force or clean water valve (1) located in the discharge pipe (6) of the accompanying submersible motor pump (3), are turned off (see FIG. 27*th* and FIG. 28).

Subsequently, it enters the third general stage, soaking cleaning compounds soaking, represented by FIG. 29 *e*. At this stage of the cleaning, soaking of cleaning compounds that were injected in the previous stage is performed. Zones A, B and C are disabled. The submersible motor pump (3) and external force (or valve for clean water (1) located in the discharge line (6) of the accompanying submersible motor pump (3), FIG. 27 or 28) stopped or disabled and the valves of cleaning compounds (1) of the three closed zones A, B and C, the soaking step is initiated, with the cleaning compounds in the interior of the suction sleeve (4) and in the interior of the submersible motor pump (3). This step may take several minutes (usually, 10 to 20 minutes or more).

Then, it begins the fourth general stage; removal and cleaning (FIG. 29 *f, g, h*). In this general stage, the same sequence of the first three washings is performed again, i.e. the first washing, in zone A of impellers (14), FIG. 29*f*; second washing in zone B of motor (12), FIG. 29*g* and third and last washing, in zone C, central, where the suction filter is located (16) FIG. 29*h*.

In the FIG. 29*f* is shown, in detail, the operation of the first washing, the removal and cleaning process, with the zone A of impellers (14), activated. The submersible pump (3) is stopped and the valves (1), located in the suction pipes (5) and discharge pipes (6), are closed. With the external force activated (gravitationally; manually; annexed motor pump running or when there is another accompanying submersible motor pump (3), FIG. 27 or FIG. 28. In this case, the valve can be used for clean water (1) of the accompanying submersible motor pump (3), to operate and allow the pressurized water flow for clean through the clean water valve (1) of the zone A of the submersible motor pump, to be cleaned, valves for clean water (1) of the zone A and for dirty water (1) of the zone B of the submersible motor pump are closed. Inverse flow of water or backwashing, from the zone A of impellers (14) to zone B of motor. Then, the valves for clean water (1) of zone A and valves for dirty water of zone B are closed Subsequently, the second washing of the removal and cleaning process is initiated (FIG. 29*g*, with the zone 13 of motor activated. The valves for clean water (1) of zone B and valves for dirty water of zone A are opened. It is produced normal flow of water, i.e. from zone B of motor (15) towards zone A of impellers (14). Then, the valves for clean water (1) on the suction sleeve of zone B and valves for dirty water located under the suction sleeve of zone A are closed.

In the FIG. 29*h* it is observed the third and last washing of the removal and cleaning process, with the zone C, central, activated. The valves for clean water (1) of zone C, central, where is located the suction filter (16) and the valves for dirty water (1) located on zones A and B are opened. It is produced normal flow and inverse or backwashing flow, from zone C, central, from suction filter (16) towards zone A of impellers (14) and from center towards zone B of motor (15).

Then, the valves for clean water (1) in the zone C, for dirty water (1) in zones B and A are closed (also the valves for dirty water (1), in the zone C, are closed). Finally, at the end of the cycle, the external force or accompanying submersible motor pump (3) is stopped, FIG. 27 or FIG. 28, with its valve for clean water (1) located on the discharge pipe (6), deactivated. Then the valves (1), located on the suction (5) and discharge (6) pipes and the submersible pump (3) is activated, definitively. All valves for dirty water (of zones A, B and C) are opened, including the valve for dirty water (1), located under the discharge pipe (where the last residues and impurities, mixed with dirty water are ejected). After finalizing the cleaning cycle, and without the presence of residues, sediments and impurities mixed with water (detected by the multi-parametric sensors (2), specially turbidity, electrical conductivity and chemical compounds sensors), all the valves for water (of zones A, B and C and from discharge pipe (6)) are closed and the submersible motor pumps (3) continues its normal operation.

Finally, the fifth and last general stage corresponding to the end of the cleaning process comes, represented by FIG. 29*i*. In this last general step, it is observed the end of cleaning process of the submersible motor pumps (3) with suction sleeves (4). Here, at the end previous stage (third and final washing of the removal and cleaning process), all valves for cleaning (1), (clean water from zones A, B and C and from dirty water from zones A, B, C of discharge pipe (6) and the cleaning compounds of the three zones are closed, and the submersible motor pump (3) resumes its normal operation cycle to a future cleaning cycle.

The invention claimed is:

1. A cleaning system for a submersible motor pump comprising:

a submersible motor pump;

a suction sleeve covering the submersible motor pump, the suction sleeve linked to the submersible motor pump by means of a support;

the suction sleeve divided into three zones comprising zone A of impellers, zone B of a motor pump and a central zone C, around a suction filter of the submersible motor pump between zones A and B;

a pair of flanges located at each end of the suction sleeve forming a space between the submersible motor pump and an inner part of the suction sleeve, wherein a first flange is located in zone B of the motor pump wherein a suction pipe is connected for entry of fluid to the submersible motor pump, and wherein a second flange is located in zone A of impellers, the second flange being crossed by a discharge connected to the impellers of the submersible motor pump;

valves for clean water, valves for dirty water and valves for injecting chemical cleaning compounds located in zones A, B and C of the suction sleeve; and sensors located in zones A, B and C of the suction sleeve.

2. The cleaning system according to claim 1, wherein the submersible motor pump and the suction sleeve are arranged horizontally.

3. The cleaning system according to claim 1, wherein the submersible motor pump and the suction sleeve are arranged vertically.

* * * * *